United States Patent [19]

Iba et al.

[11] Patent Number: 5,069,105

[45] Date of Patent: Dec. 3, 1991

[54] MUSICAL TONE SIGNAL GENERATING APPARATUS WITH SMOOTH TONE COLOR CHANGE IN RESPONSE TO PITCH CHANGE COMMAND

[75] Inventors: Akio Iba, Tokorozawa; Kenichi Tsutsumi, Tokyo, both of Japan

[73] Assignee: Casio Computer Co., Ltd., Tokyo, Japan

[21] Appl. No.: 471,835

[22] Filed: Jan. 29, 1990

[30] Foreign Application Priority Data

Feb. 3, 1989 [JP] Japan ..... 1-24025
Feb. 15, 1989 [JP] Japan ..... 1-33535
May 15, 1989 [JP] Japan ..... 1-120750

[51] Int. Cl.[5] ..... G10H 7/00

[52] U.S. Cl. ..... 84/605; 84/622; 84/604

[58] Field of Search ..... 84/603, 604, 605, 622, 84/623, 624, 625, 627, 628, 659

[56] References Cited

U.S. PATENT DOCUMENTS 4,213,366 7/1980 Niimi et al. .
4,352,312 10/1982 Whitefield et al. .
4,461,199 7/1984 Hiyoshi et al. .
4,463,650 8/1984 Rupert ..... 84/622
4,635,520 1/1987 Mitsumi .
4,667,556 5/1987 Hanzawa et al. .
4,748,888 6/1988 Oya ..... 84/604
4,785,707 11/1988 Suzuki ..... 84/605
4,920,851 5/1990 Abe ..... 84/622
4,947,723 8/1990 Kawashima et al. ..... 84/603
4,974,485 12/1990 Nagai et al. ..... 84/605

FOREIGN PATENT DOCUMENTS

EP0114123 7/1984 European Pat. Off. .
EP0150736 8/1985 European Pat. Off. .

*Primary Examiner*—William M. Shoop, Jr.
*Assistant Examiner*—Helen Kim
*Attorney, Agent, or Firm*—Frishauf, Holtz, Goodman & Woodward

[57] ABSTRACT

Disclosed is a musical tone signal generating apparatus for an electronic musical instrument. When waveforms are switched to change a tone color in correspondence with a change in pitch, waveforms are switched not simultaneously with a change in pitch but when waveform data corresponding to a loop end address is read out, and a peak value of the waveform falls within a predetermined range or a zero-crossing point is detected, thereby smoothly switching waveforms. The pitch is also changed at the above-mentioned timing to prevent generation of an unnecessary tone color upon switching. Furthermore, waveforms are switched by cross-fade control to more smoothly switch output waveforms.

18 Claims, 14 Drawing Sheets

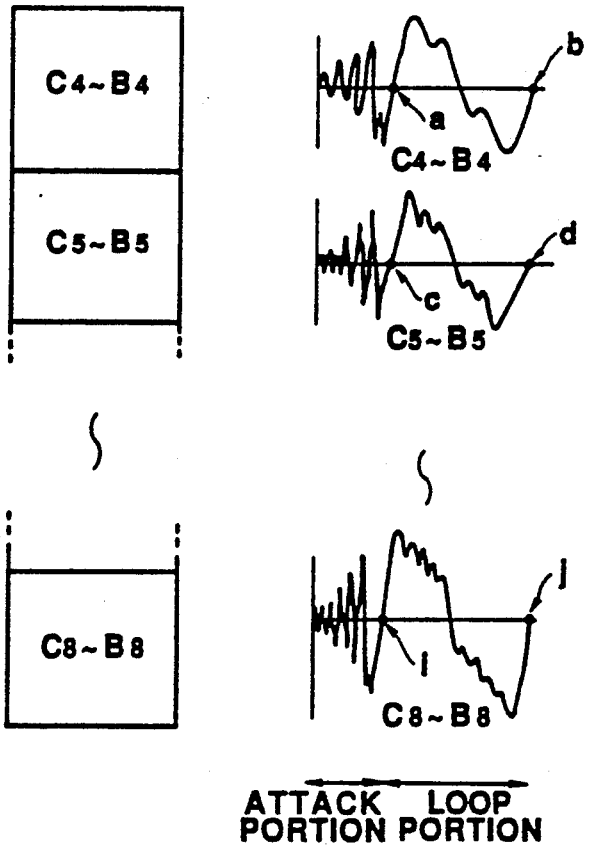
FIG.2(A) FIG.2(B)
FIG.3(A)
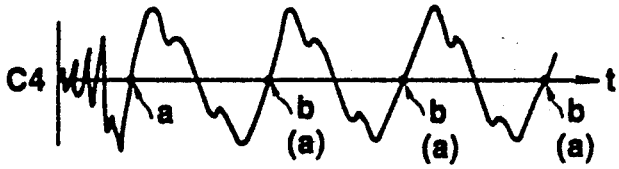
FIG.3(B)
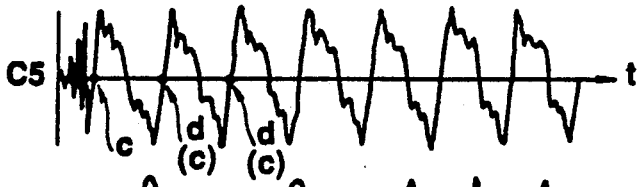
FIG.4(A)
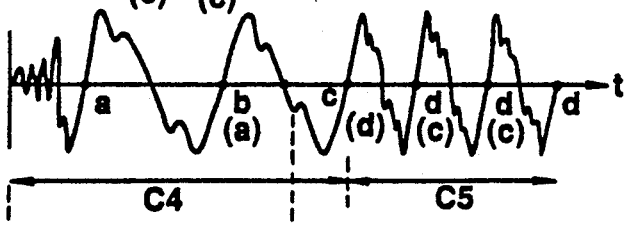
FIG.4(B)
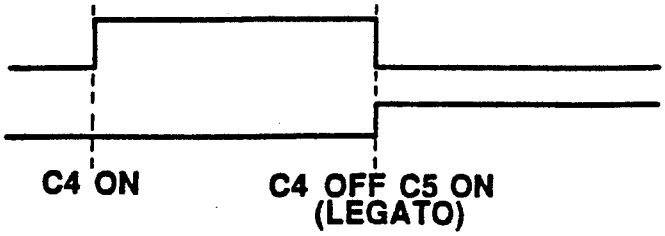

FIG.16A
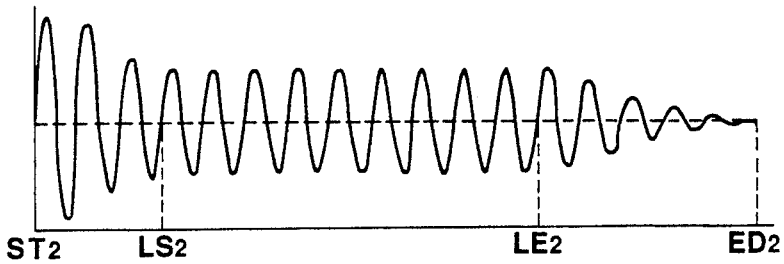
FIG.16B
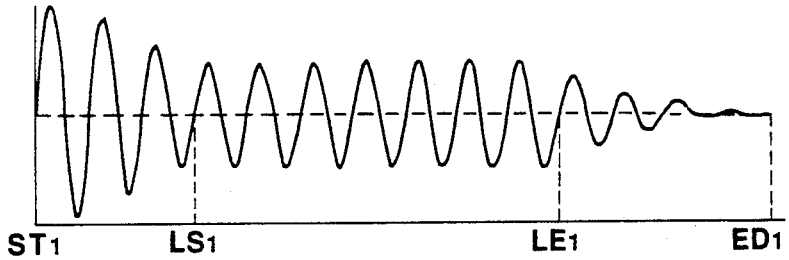
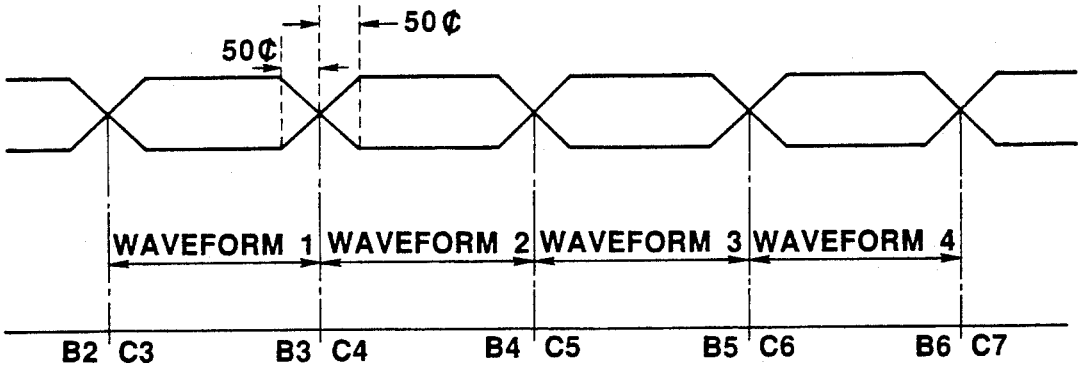
FIG.17

MUSICAL TONE SIGNAL GENERATING APPARATUS WITH SMOOTH TONE COLOR CHANGE IN RESPONSE TO PITCH CHANGE COMMAND

BACKGROUND OF THE INVENTION

1. Field of the Invention

The present invention relates to a musical tone signal generating apparatus for an electronic musical instrument and, more particularly, to a musical tone signal generating apparatus which can smoothly switch an output musical tone waveform in correspondence with a change in designated pitch.

2. Description of the Related Art

Conventionally, a musical tone signal generating apparatus of a waveform-data read type is known. In this apparatus, waveform data is read out from a waveform data memory storing digital waveform data and a musical tone is generated like in a PCM system on the basis of pitch data designated in accordance with a pitch designation operation by operating a pitch designation switch or the like. In an electronic musical instrument adopting a musical tone signal generating apparatus of this type, when a pitch of a musical tone in generation is to be smoothly changed, e.g., when a legato, a pitch bend operation, a portamento operation a slide (glissando) operation, or the like is executed, a pitch is changed by changing only a data reading speed (read frequency or an address increment speed) without changing waveform data read out from the waveform memory in correspondence with a musical tone in generation (a musical tone immediately before a pitch is changed).

However, when musical tones are generated by reading out one recorded waveform in correspondence with pitches over a wide range, tone colors cannot be naturally changed in correspondence with a compass of musical tones unlike in an acoustic musical or natural instrument in accordance with a change in pitch.

For example, when an instruction for producing a musical tone of a pitch $C_5$ is issued by, e.g., the legato while a musical tone of a pitch $C_4$ is read out and produced in a loop mode between loop start and end addresses, the same waveform data of the same loop portion as the pitch $C_4$ is directly used, and a read speed (read frequency) is merely changed in correspondence with the pitch $C_5$. Therefore, since waveform data before and after the legato is executed is left unchanged, a tone color is not naturally changed in correspondence with a compass unlike in an acoustic musical instrument. In particular, when a pitch is largely changed by, e.g., a pitch bend operation, an unnatural state is caused before and after a change in pitch.

In order to prevent a change unnatural in tone color according to a change in pitch, a method called multisampling has been used. In this method, a waveform corresponding to one tone color is sampled and prestored in a memory in units of predetermined ranges (e.g., one octave), and the stored waveform is selectively read out and generated in accordance with a designated pitch in a reproduction mode.

However, in a musical tone signal generating apparatus of this type, when a pitch is largely changed upon operation of a bender during generation of a musical tone, a tone color tends to be changed. When a pitch is changed beyond the predetermined range, a waveform in a higher or lower compass adjacent to a compass of a waveform in generation is read out in correspondence with the designated pitch, and the waveform before the pitch is changed is switched to the waveform of the adjacent range.

However, memory spaces for storing waveforms in units of tone ranges are independent of each other for each waveform of a range. Thus, when the waveforms are switched by changing addresses of independent memory spaces, the waveforms may become discontinuous. In practice, it is difficult to generate musical tones by connecting waveforms of adjacent tone ranges.

For example, when a tone generation instruction of a pitch $C_5$ is issued by, e.g., the legato while a musical tone of a pitch $C_4$ is read out and produced in a loop mode between loop start and end addresses, a read speed is immediately changed in correspondence with the pitch $C_5$, and waveform data of the same loop portion as the pitch $C_4$ is read out. Therefore, when a pitch is changed, since quite different waveform data is generated in a loop period, and the waveform data is read out, a musical tone of an unnecessary tone color is instantaneously generated.

SUMMARY OF THE INVENTION

The present invention has been made to solve the conventional problems, and has as its object to provide a musical tone signal generating apparatus which can naturally change a tone color before and after a pitch is changed when an operation for smoothly changing a pitch of a musical tone in generation, such as a legato, a pitch bend operation, a portamento operation, a slide (glissando) operation, or the like is executed.

According to one aspect of the present invention, there is provided a musical tone signal generating apparatus comprising:

memory means for storing different waveform data in correspondence with a plurality of different tone ranges;

pitch designation operation means for designating a pitch of a musical tone;

waveform designation means for designating, from the memory means, waveform data corresponding to a tone range to which the pitch designated by the pitch designation operation means belongs;

readout means for reading out the waveform data designated by the waveform designation means at a frequency corresponding to the pitch;

musical tone signal output means for generating a musical tone signal on the basis of the waveform data read out by the readout means;

timing signal generation means, operative when a pitch of a musical tone signal in generation is changed to a new pitch belonging to a new tone range different from a current range to which the pitch belongs by the pitch designation operation means, for generating a switching timing signal; and switching means for causing the readout means to read out waveform data corresponding to the new tone range to which the new pitch designated by the pitch operation designation means belongs in response to the switching timing signal generated by the timing signal generation means.

Therefore, according to the present invention, even if a pitch is changed, a waveform can be smoothly changed in correspondence with a change in pitch.

It is another object of the present invention to provide a musical tone signal generating apparatus which can also smoothly change a tone color in accordance with an operation such as a legato for smoothly changing a pitch of a tone in generation.

According to another aspect of the present invention, there is provided a musical tone signal generating apparatus for an electronic musical instrument, comprising:

memory means for storing different items of waveform data each having a loop period in correspondence with a plurality of different tone range;

pitch designation operation means for designating a pitch of a musical tone;

readout means for designating and reading out, from the memory means, waveform data corresponding to a tone range to which the pitch designated by the pitch designation operation means belongs;

musical tone signal generation means for generating a musical tone signal on the basis of the waveform data read out by the readout means;

timing signal generation means, operative when the pitch designation operation means is operated to change a pitch of a musical tone signal in generation to a new pitch belonging to another tone range different from the range to which the pitch belongs, for generating a switching timing signal when waveform data at a loop end address is read out; and waveform switching means for causing the readout means to designate and read out waveform data corresponding to the tone range to which the new pitch designated by the pitch designation operation means belongs in response to the switching timing signal generated by the timing signal generation means.

Therefore, according to the present invention, since a changing operation of a tone color after a pitch change is performed at a timing corresponding to a loop end address, a tone color can be naturally changed without generating a musical tone of an unnecessary tone color.

It is still another object of the present invention to provide a musical tone signal generating apparatus which is free from an unnecessary instantaneous change in tone color when a pitch is changed upon execution of an operation such as a legato for smoothly changing a pitch in generation.

According to still another aspect of the present invention, there is provided a musical tone signal generating apparatus for an electronic musical instrument, comprising:

memory means for storing a plurality of different items of waveform data in correspondence with a plurality of different tone ranger;

pitch designation operation means for designating a pitch of a musical tone;

readout means for designating and reading out, from the memory means, waveform data corresponding to a tone range to which the pitch designated by the pitch designation operation means belongs;

musical tone signal generation means for generating a musical tone signal on the basis of the waveform data read out by the readout means;

timing signal generation means, operative when the pitch designation operation means is operated to change a pitch of a musical tone signal in generation to a new pitch belonging to a tone range different from the range to which the pitch belongs, for generating a switching timing signal; and frequency switching means for causing the readout means to read out the waveform data from the memory means at a frequency corresponding to the pitch designated by the pitch designation operation means in response to the switching timing signal from the timing signal generation means.

Therefore, according to the present invention, there can be provided a musical tone signal generating apparatus which can smoothly change a pitch in correspondence with the legato or the pitch bend operation without instantaneously generating a musical tone of an unnecessary tone color.

It is still another object of the present invention to provide a musical tone signal generating apparatus which can naturally change a tone color before and after a pitch is changed upon execution of a style of playing or an operation for smoothly changing a pitch of a musical tone in generation and can prevent an instantaneous unnecessary change in tone color when the pitch is changed.

According to still another aspect of the present invention, there is provided a musical tone signal generating apparatus for an electronic musical instrument, comprising:

memory means for storing a plurality of items of different waveform data in correspondence with a plurality of different tone range;

pitch designation operation means for designating a pitch of a musical tone;

waveform designation means for designating, from the memory means, waveform data corresponding to a tone range to which the pitch designated by the pitch designation operation means belongs;

readout means for designating and reading out, from the memory means, waveform data designated by the waveform designation means on the basis of a frequency corresponding to the pitch designated by the pitch designation operation means;

timing signal generation means, operative when the pitch designation operation means is operated, for generating a switching timing signal;

waveform switching means for causing the readout means to designate waveform data corresponding to the tone range to which the new pitch designated by the pitch designation operation means belongs in response to the switching timing signal generated by the timing signal generation means; and frequency switching means for causing the readout means to read out the waveform data from the memory means at a frequency corresponding to the pitch designated by the pitch designation operation means in response to the switching timing signal from the timing signal generation means.

Therefore, there can be provided a musical tone signal generating apparatus which can attain a natural change in tone color before and after a pitch is changed in addition to change in a pitch, when a pitch changing operation for changing a pitch of a musical tone in generation is performed, and can provide a performance effect very suitable for a legato, a pitch bend operation, and the like.

It is still another object of the present invention to provide a musical tone signal generating apparatus for an electronic musical instrument, which can smoothly change waveforms in correspondence with a change in pitch when a waveform is changed to a waveform of another tone range.

According to still another aspect of the present invention, there is provided a musical tone signal generating apparatus for an electronic musical instrument, comprising:

memory means for storing plurality of items of different waveform data in correspondence with a plurality of different tone range;

pitch designation operation means for inputting a pitch of a musical tone;

waveform designation means for designating, from the memory means, waveform data corresponding to a tone range to which the pitch designated by the pitch designation operation means belongs;

waveform readout means, comprising two readout means, for always reading out waveform data from the memory by one of the two readout means, and for, when waveform data corresponding to a tone range to which a new pitch designated by the pitch designation operation means belongs is different from current waveform data, reading out new waveform data by the other readout means;

amplitude control means for gradually decreasing a wave height value of the previous waveform data from the two readout means to zero, and gradually increasing a wave height value of the new waveform data to a predetermined value accordingly;

mixing means for mixing the two waveform data from the amplitude control means; and musical tone signal output means for generating a musical tone signal based on the waveform data from the mixing means.

According to the present invention, a waveform can be changed in accordance with a change in pitch, and tone color waveforms can be naturally connected.

BRIEF DESCRIPTION OF THE DRAWINGS

For those who are skilled in the art, other objects and features of the present invention will be easily understood from the description of the preferred embodiments of the present invention taken in conjunction with the accompanying drawings, in which:

FIG. 2A shows storage areas in units of tone ranges in a PCM waveform memory 8;

FIG. 2B shows musical tone signal waveforms corresponding to PCM waveform data stored in units of tone ranges;

FIGS. 3A and 3B are charts for explaining PCM waveform data read out in a loop mode at speeds corresponding to pitches $C_4$ and $C_5$, respectively;

FIGS. 4A and 4B are charts for explaining a pitch changing operation and a waveform data changing operation when a musical tone signal of a pitch $C_4$ is changed to a musical tone signal of a pitch $C_5$;

FIGS. 16A and 16B are waveform charts of the fifth embodiment of the present invention;

FIG. 17 is a chart showing a compass relationship for explaining cross-fade in the fifth embodiment.

DETAILED DESCRIPTION OF THE PREFERRED EMBODIMENTS

Preferred embodiments of the present invention will be described hereinafter with reference to the accompanying drawings.

FIRST EMBODIMENT

Arrangement

Figure 1:
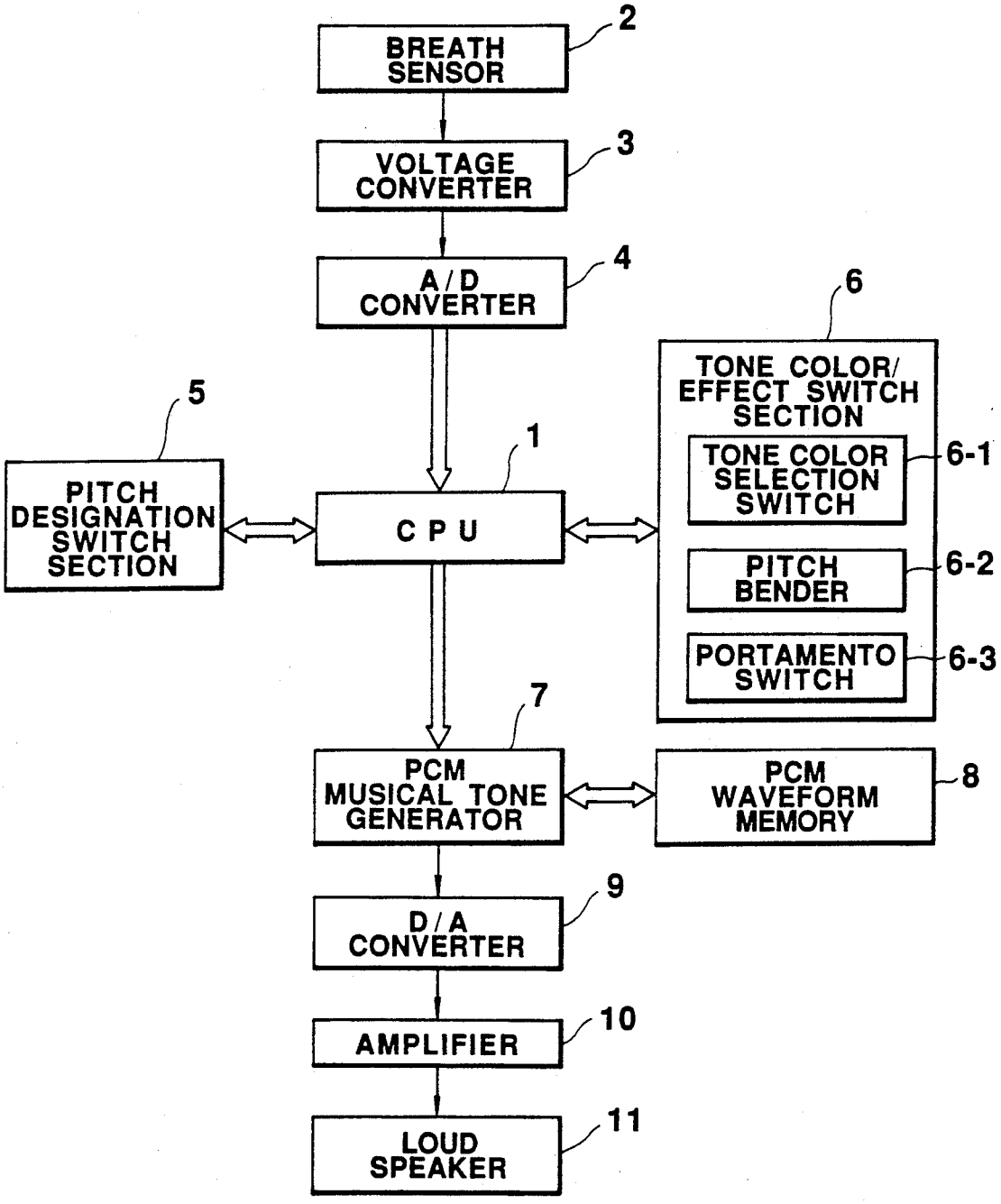
FIG. 1 is a block diagram of the entire circuit of an electronic wind instrument according to the first embodiment of the present invention.

An arrangement of an electronic wind instrument according the first embodiment to which a musical tone signal generating apparatus of the present invention is applied will be described below with reference to the block diagram of FIG. 1. A CPU 1 controls the entire circuit shown in FIG. 1, and the entire circuit blocks will be described below based on the functions of the CPU 1. A voltage converter 3 converts breath data detected by a breath sensor 2 into an analog voltage value. The analog voltage value is converted to a digital value by an A/D converter 4 so that corresponding digital breath data is supplied to the CPU 1.

The CPU 1 receives pitch data designated by a pitch designation operation at a pitch designation switch section 5, tone color control data associated with a tone color selected upon operation of a tone color selection switch 6-1 at a tone color/effect switch section 6, and pitch change control data appended by a pitch changing operation upon operation of a pitch bender 6-2 or a portamento setup switch 6-3. The CPU 1 sends musical tone control data based on these various data to a PCM musical tone generator 7.

A PCM waveform memory 8 is divided into storage areas in units of a plurality of tone ranges, e.g., $C_4$ to $B_4$, $C_5$ to $B_5$, . . . , $C_8$ to $B_8$, as shown in FIG. 2A, and prestores a plurality of PCM waveform data corresponding to an attack portion and a loop portion shown in the waveform chart of FIG. 2B. Note that the loop length of the loop portion is not limited to one period. For example, a loop portion corresponding to a plurality of periods may be stored. The PCM musical tone generator 7 has pairs of loop start and end address data (e.g., a and b, c and d, ..., i and j; FIG. 2B) for reading out a loop portion of the PCM waveform data in units of tone ranges in a loop mode (repetitively), and an envelope generator for generating an envelope signal. The PCM musical tone generator 7 reads out PCM waveform data corresponding to a tone range, to which pitch data received from the CPU 1 belongs, at a speed (frequency) corresponding to the pitch data, and generates digital data subjected to envelope control based on an envelope signal. The generator 7 then sends the generated digital data to a D/A converter 9.

For example, when a note ON operation occurs upon a breath operation at the breath sensor 2 after a pitch $C_4$ is designated upon operation of the pitch designation switch section 5, the PCM musical tone generator 7 accesses a storage area (FIG. 2A) of waveform data, corresponding to a tone range to which the pitch $C_4$ belongs, in the PCM waveform memory 8, and reads out an attack portion and then a loop portion between the loop start and end addresses a and b in a loop mode for a predetermined period of time t corresponding to the breath operation (FIG. 3A). Similarly, when a note ON operation occurs upon the breath operation after a pitch $C_5$ is designated, the PCM musical tone generator 7 reads out a loop portion between the loop start address c and the loop end address d in waveform data corresponding to a compass to which the pitch $C_5$ belongs (FIG. 3B).

The D/A converter 9 converts digital data input from the PCM musical tone generator 7 into an analog tone signal. The analog tone signal is amplified by an amplifier 10, and the amplified signal is produced as a musical tone through a loudspeaker 11.

A case will be examined below wherein a musical tone of a pitch $C_5$ is produced by a legato while a musical tone of, e.g,. a pitch $C_4$ is produced (the same applies to a case wherein a pitch bend effect is provided upon operation of a pitch bender or a case wherein a portamento effect is provided upon operation of a switch of the tone color/effect switch section 6) (FIG. 4B). As shown in FIG. 4A, in response to a note ON operation of a musical tone of the pitch $C_4$, the PCM musical tone generator 7 reads out waveform data in the PCM waveform memory 8 corresponding to a tone range to which the pitch $C_4$ belongs at a read speed based on the pitch $C_4$, so that it reads out an attack portion and then a loop portion in a loop mode between the loop start and end addresses a and b. As shown in FIGS. 4A and 4B, when a note ON operation of a musical tone of the pitch $C_5$ occurs by the legato during the loop operation, waveform data is switched to a new one corresponding to a tone range to which the pitch $C_5$ belongs upon completion of read access of the currently looped waveform data, i.e., at a timing when waveform data at the loop end address b is read out. The new waveform data is then read out in a loop mode between the loop start and end addresses c and d of the new waveform data at a read speed based on the pitch $C_5$ (FIG. 2B). Therefore, waveform data read out from the PCM waveform memory 8 in correspondence with the pitch $C_4$ is quite different from waveform data read out from the PCM waveform memory 8 in correspondence with the pitch $C_5$.

Figure 5:
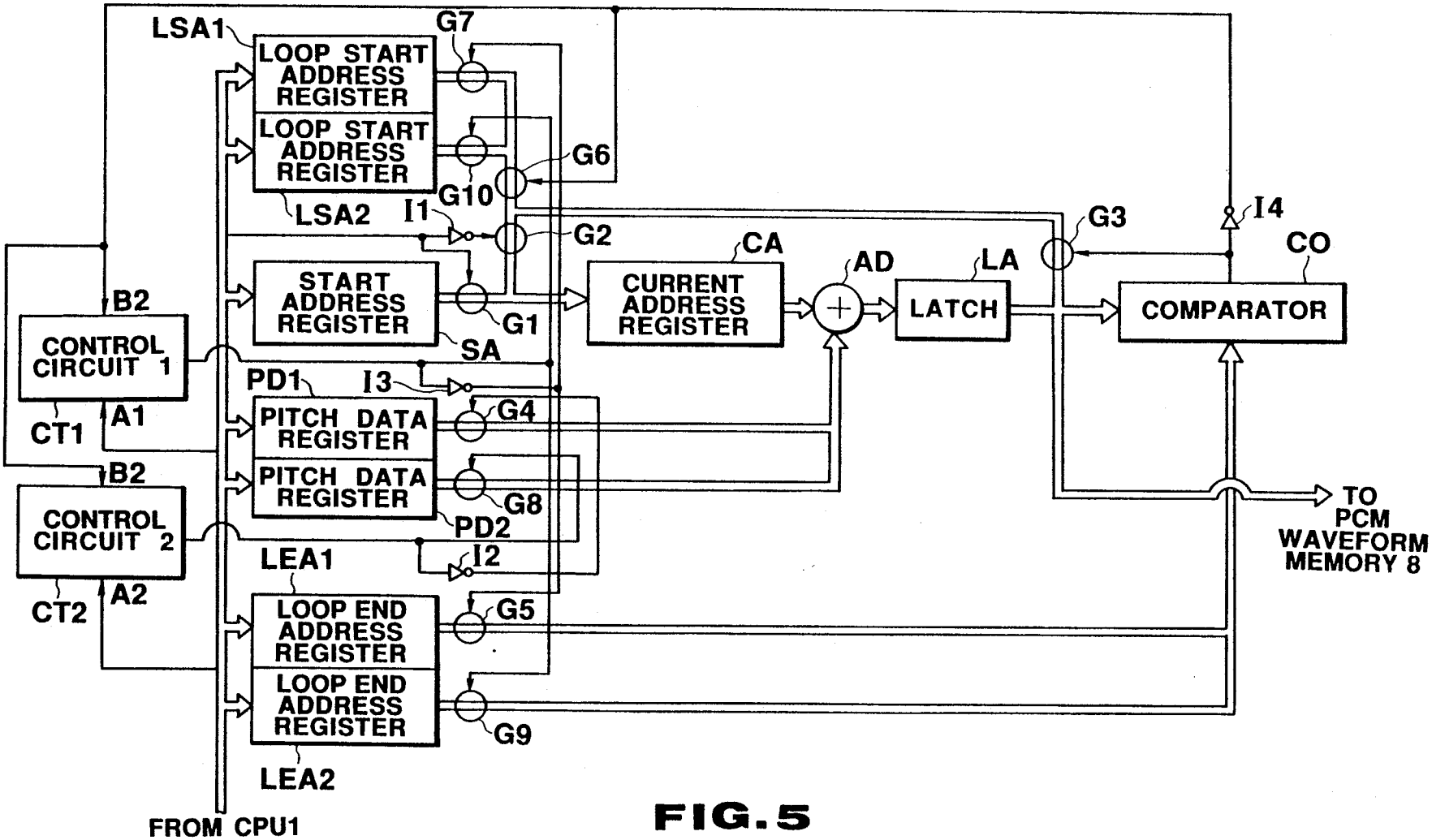
FIG. 5 is a circuit diagram showing a detailed circuit arrangement of a PCM musical tone generator 7.

A detailed circuit arrangement of the PCM musical tone generator 7 will be described below with reference to FIG. 5. In FIG. 5, a pitch data register PD1 receives from the CPU 1 pitch data based on a pitch designation operation at the pitch designation switch section 5. A start address register SA receives from the CPU 1 a start address signal for reading out waveform data corresponding to a tone range to which the pitch data belongs from the PCM waveform memory 8.

A loop start address register LSA1 and a loop end address register LEA1 respectively receive from the CPU 1 a loop start address signal and a loop end address signal for reading out a loop portion of waveform data corresponding to a tone range to which the pitch data belongs from the PCM waveform memory 8 in a loop mode.

A gate G1 is an output gate which is connected to the output of the start address register SA, and is instantaneously enabled in response to a note ON signal to send the start address signal set in the start address register SA to a current address register CA. A gate G2 is normally enabled, and is instantaneously disabled in response to a note ON signal input through an inverter I1.

A comparator CO receives a current address signal from a latch LA, and normally outputs a signal "1". A gate G3 is normally enabled in accordance with the signal "1" from the comparator CO. The address signal from the latch LA is fed back to the current address register CA through the normally ON gates G3 and G2, and is supplied to an adder AD. The address signal is added to pitch data set in the pitch data register PD1, as will be described later.

A gate G4 is an output gate which is connected to the output of the pitch data register PD1, and is normally enabled in accordance with an output signal "0" supplied from a control circuit CT2 through an inverter I2. The gate G4 sends the pitch data set in the pitch data register PD1 to the adder AD. The adder AD adds the current address signal set in the current address register CA and the pitch data input through the gate G4 using clocks of a predetermined frequency, thereby incrementing the current address signal at a speed based on the pitch data. The sum from the adder AD is sequentially supplied to the latch LA. The latch LA sends the current address signal incremented at a speed based on the pitch data as a waveform data read address signal to the PCM waveform memory 8.

A gate G5 is an output gate which is connected to the output of the loop end address register LEA1, and is normally enabled in accordance with an output signal "0" from the control circuit CT1. The gate G5 sends the loop end address signal to the comparator CO.

The comparator CO compares the current address signal and the loop end address signal, and instantaneously outputs a coincidence signal "0" when it determines that the two signals coincide with each other. When the coincidence signal "0" is output from the comparator CO, the gate G3 is instantaneously disabled, and a gate G6 is instantaneously enabled in response to the coincidence signal "0" input through an inverter I4.

A gate G7 is connected to the output of the loop start address register LSA1, and is normally enabled in accordance with an output signal "0" supplied from the control circuit CT 1 through an inverter I3.

The gate G6 is enabled upon reception of the coincidence signal input from the comparator CO through the inverter I4, and supplies a loop start address signal set in the loop start address register LSA1 or a loop start address register LSA2 to the current address register CA as a loop start address signal for starting loop read access of a loop portion of waveform data through the normally ON gate G2.

Thereafter, when the current address signal is incremented by the adder AD and the coincidence signal "0" is output from the comparator CO, the loop start address signal is input to the current address register CA, and is added to the pitch data input through the gate G4 by the adder AD to increment the address signal for reading out the waveform data in a loop mode. Thus, the address signal is sequentially sent to the PCM waveform memory 8.

A pitch data register PD2 receives pitch data from the CPU 1.

A gate G8 is an output gate which is connected to the output of the pitch data register PD2, and is normally disabled in accordance with an output signal "0" from a flip-flop at the output stage of a control circuit CT2. The flip-flop normally latches "0".

When the control circuit CT2 receives a pitch change instruction signal from the CPU 1, a flip-flop at an input stage A2 of the circuit CT2 is set to output a signal "1". When the control circuit CT2 receives a coincidence signal from the comparator CO through the inverter I4, a flip-flop at an input stage B2 of the circuit CT2 is set to output a signal "1". More specifically, when the control circuit CT2 receives the pitch change signal, and then receives the coincidence signal, the flip-flop at the output stage latches a signal "1", and then resets the flip-flop at the input stage A2.

The gate G4 is disabled, and the gate G8 is enabled. As a result, the changed pitch data is supplied from the pitch data register PD2 to the adder AD, and the current address signal is incremented at a speed based on new pitch data. As has been described above, every time the coincidence signal "0" is output from the comparator CO, the current address register CA receives the loop start address signal set in the loop start address register LSA1 as a current address signal, and an address signal for reading out waveform data in a loop mode is sent to the PCM waveform memory 8 through the latch LA.

The loop start address register LSA2 and a loop end address register LEA2 respectively receive loop start and end address signals for reading out a loop portion of new waveform data in the PCM waveform memory 8 in a loop mode when read access is made while changing waveform data which is being read to another waveform data.

Gates G9 and G10 are respectively connected to the outputs of the loop end and start address registers LEA2 and LSA2, and are normally disabled in accordance with an output signal "0" from the control circuit CT1.

When the control circuit CT1 receives a waveform data change instruction signal from the CPU 1, the flip-flop at the input stage Al is set to output a signal "1". Meanwhile, when the control circuit CT1 receives the coincidence signal from the comparator CO through the inverter I4, the flip-flop at the input stage B1 is set to output a signal "1". More specifically, after the control circuit CT1 receives the waveform change instruction signal, the flip-flop at the output stage outputs a signal "1" at an instance when the circuit CT1 receives the coincidence signal, and resets the flip-flop at the output stage B1.

Thus, the gates G5 and G7 are disabled, and the gates G9 and G10 are enabled. As a result, the loop end address register LEA supplies the loop end address signal to the comparator CO through the gate G9, and the loop start address register LSA2 supplies the current address register CA through the gates G10, G6, and G2.

Operation

Figure 6:
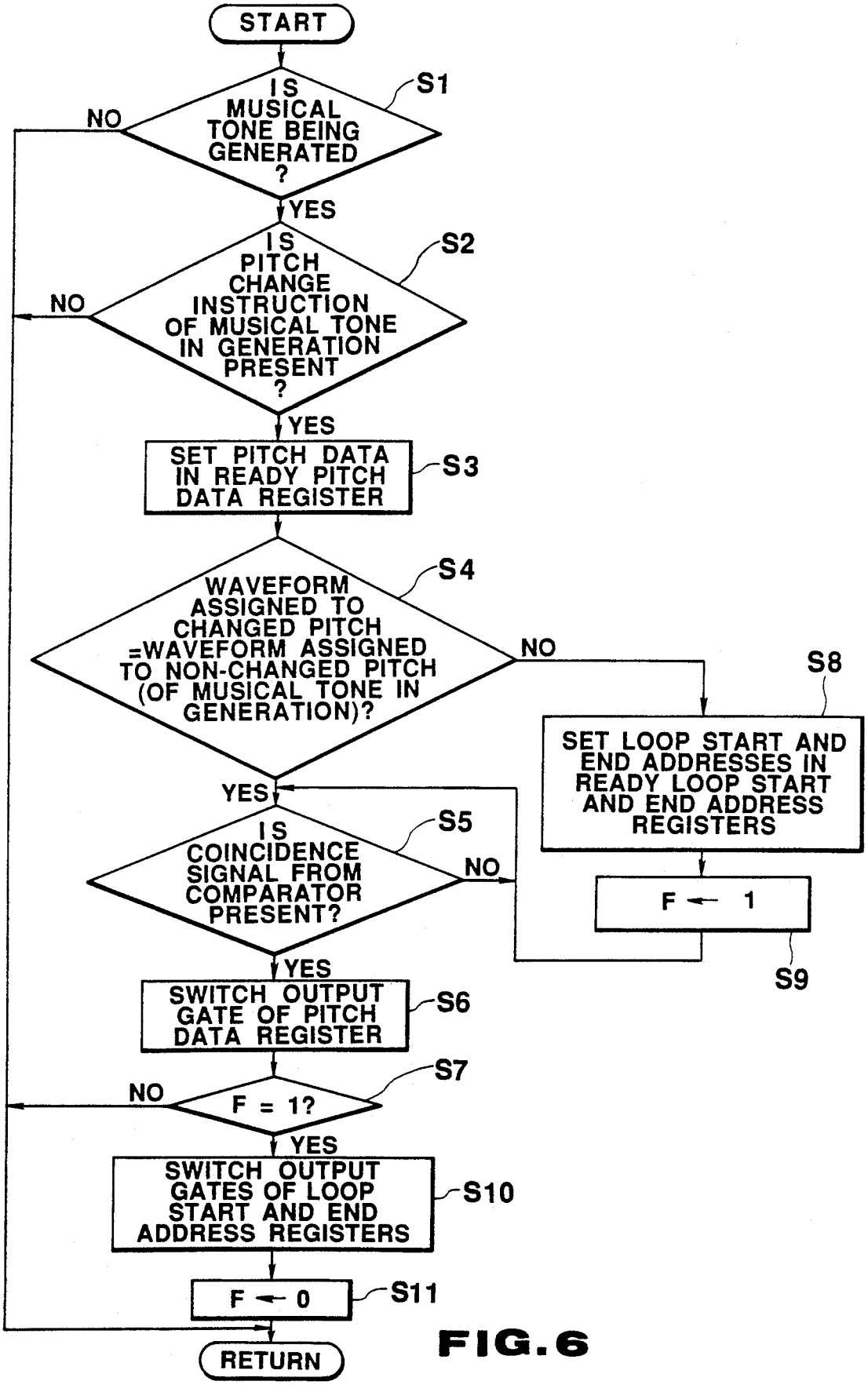
FIG. 6 is a flow chart for explaining pitch change control processing for a musical tone in generation by a CPU 1.

The operation of the electronic wind instrument according to the first embodiment will be described below with reference to FIG. 5 on the basis of the flow chart of FIG. 6 showing a pitch change control processing operation for a musical tone in generation by the CPU 1. This flow chart starts upon timer interrupt to a main flow (not shown).

It is checked if a musical tone is being produced, i.e., if the PCM musical tone generator 7 is generating a musical tone signal (step S1). If YES in step S1, it is checked if a pitch change instruction is issued for a musical tone in generation by the legato, the pitch bend operation, or the like (step S2). If YES in step S2, pitch data associated with a changed pitch is set in a non-busy one of the pitch data registers PD1 and PD2 in the PCM musical tone generator 7, and a pitch change instruction signal is sent to the control circuit CT2 (step S3).

It is then checked if a waveform assigned to a changed pitch is the same as one assigned to a current pitch (of a musical tone in generation) among waveform data stored in the PCM waveform memory 8 (step S4). If YES in step S4, only the pitch is changed, and the waveform need not be changed. It is then checked if the comparator CO outputs a coincidence signal (step S5). If NO in step S5, the processing in step S5 is repeated until the coincidence signal is output to determine YES in step S5. Thus, the control stands by until waveform read access progresses to the loop end address. If YES in step S5, the output gate G4 at the output side of the pitch data register PD1 is switched and disabled in response to the output signal from the control circuit CT2, and the gate G8 as an output gate of the pitch data register PD2 is enabled (step S6) to change a pitch of a musical tone in generation.

It is checked if "1" is set in a flag F which is set to be "1" only when a waveform assigned in correspondence with a pitch is to be changed in a pitch changing operation (step S7). Since YES is determined in step S4 and a waveform to be read out need not be updated to a new waveform, NO is determined in step S7, and the control returns to the main flow.

If NO in step S4, the assigned waveform must be switched to another waveform in a pitch changing operation. Thus, a loop start address of a switched new waveform is set in a non-busy one of the loop start address registers LSA1 and LSA2. In addition, a loop end address of the switched new waveform is set in a non-busy one of the loop end address registers LEA1 and LEA2. Furthermore, the CPU 1 sends a waveform change instruction signal to the control circuit CT1 to change a waveform (step S8).

The flag F is set to be "1" to indicate that a waveform must also be changed when a pitch is changed (step S9). The flow then advances to step S5, and processing operations in steps S6 and S7 are similarly executed. Since YES is determined in step S7, gate switching control is executed for the PCM musical tone generator 7 (step S10). More specifically, the gate G7 as the output gate of the loop start address register LSA1 is disabled, and the gate G10 as the output gate of the loop start address register LSA2 is enabled. In addition, the gate G5 as the output gate of the loop end address register LEA1 is disabled, and the gate G9 as the output gate of the loop end address register LEA2 is enabled. The flag F is reset to prepare for the next pitch change instruction (step S11), and the control then returns to the main flow.

If NO in step S1, since no musical tone is being produced, the control directly returns to the main flow. If NO in step S2, since no pitch change instruction is issued for a musical tone in generation, i.e., since a pitch changing operation by the legato need not be performed, the control also returns to the main flow.

In this manner, according to the electronic wind instrument of the first embodiment, when a performance by the legato, the pitch bend operation using a pitch bender, or the portamento method using a portamento switch for smoothly changing a pitch of a musical tone is executed in generation during generation of the musical tone, if a waveform which is assigned to a pitch to be changed and is stored in the PCM waveform memory 8 need not be changed upon changing of a pitch, only the pitch is changed after read access up to the loop end address of the currently reading loop portion is completed; and if the waveform is to be changed upon changing of the pitch, not only the pitch but also the waveform are changed after read access up to the loop end address is completed.

Therefore, in a performance for smoothly changing a pitch like in the legato, a tone color can be naturally changed before and after the pitch is changed without causing an instantaneous unnecessary change in tone color.

SECOND EMBODIMENT

Arrangement

Figure 7:
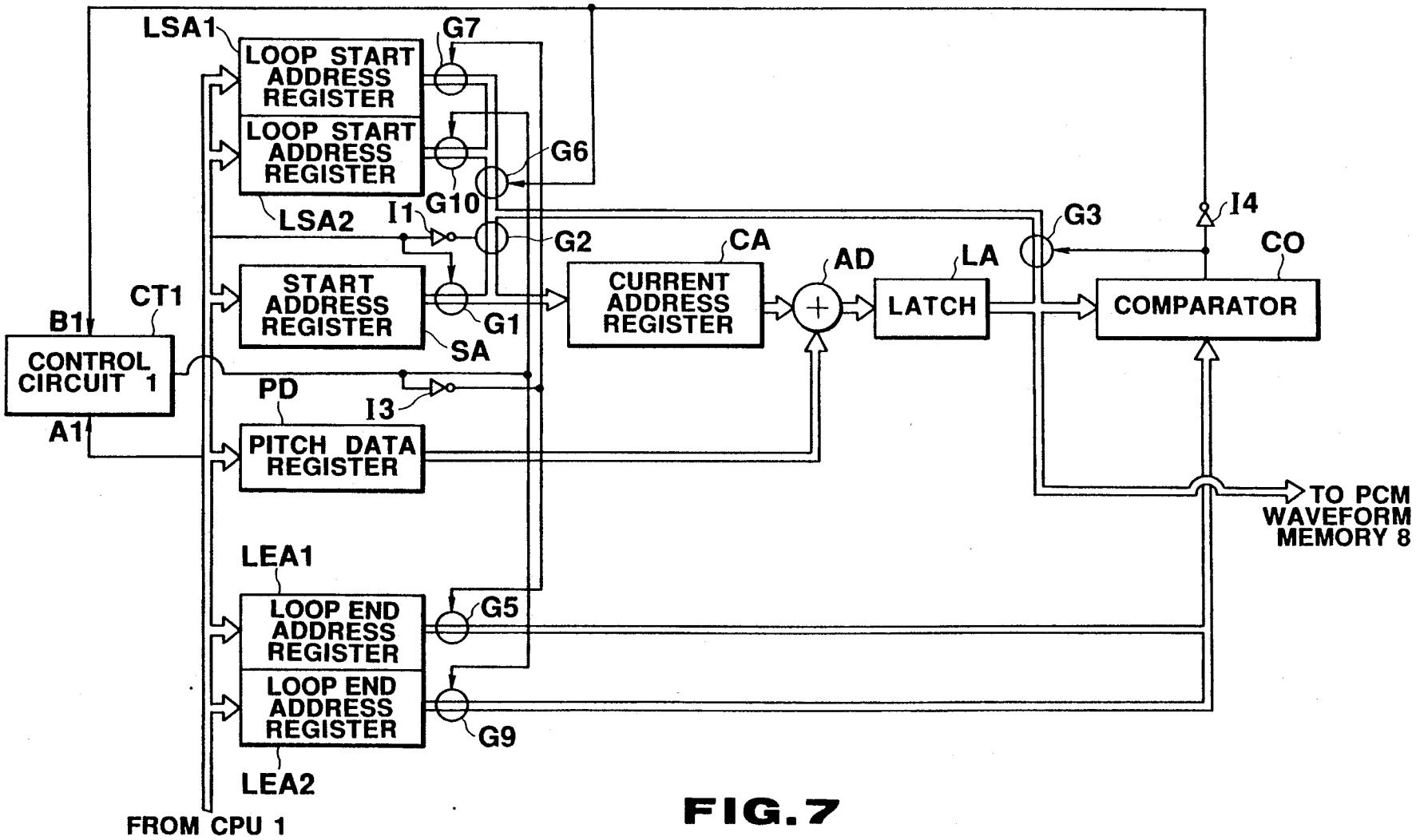
FIG. 7 is a circuit diagram showing a detailed circuit arrangement of a PCM musical tone generator 7 of an electronic wind instrument according to the second embodiment of the present invention.

An arrangement of an electronic wind instrument according to the second embodiment to which a musical tone signal generating apparatus of the present invention is applied will be described below. The block diagram of the entire electronic wind instrument is the same as FIG. 1 according to the first embodiment described above, and a detailed description thereof will be omitted. The detailed circuit arrangement of a PCM musical tone signal generator 7 in the electronic wind instrument of the second embodiment will be described below with reference to FIG. 7. In FIG. 7, the same reference numerals as in FIG. 5 in the first embodiment denote the same parts, and only a difference will be described below.

A difference between the block diagrams of FIGS. 7 and 5 is that only one pitch data register PD is arranged and does not have an output gate, and hence, there is no control circuit for switching-controlling the output gate of the pitch data register.

More specifically, at an instance of reception of new pitch data from a CPU 1, the single pitch data register PD sends the new pitch data to an adder AD to cause it to immediately increment a current address signal from a current address register CA based on the new pitch data.

Operation

Figure 8:
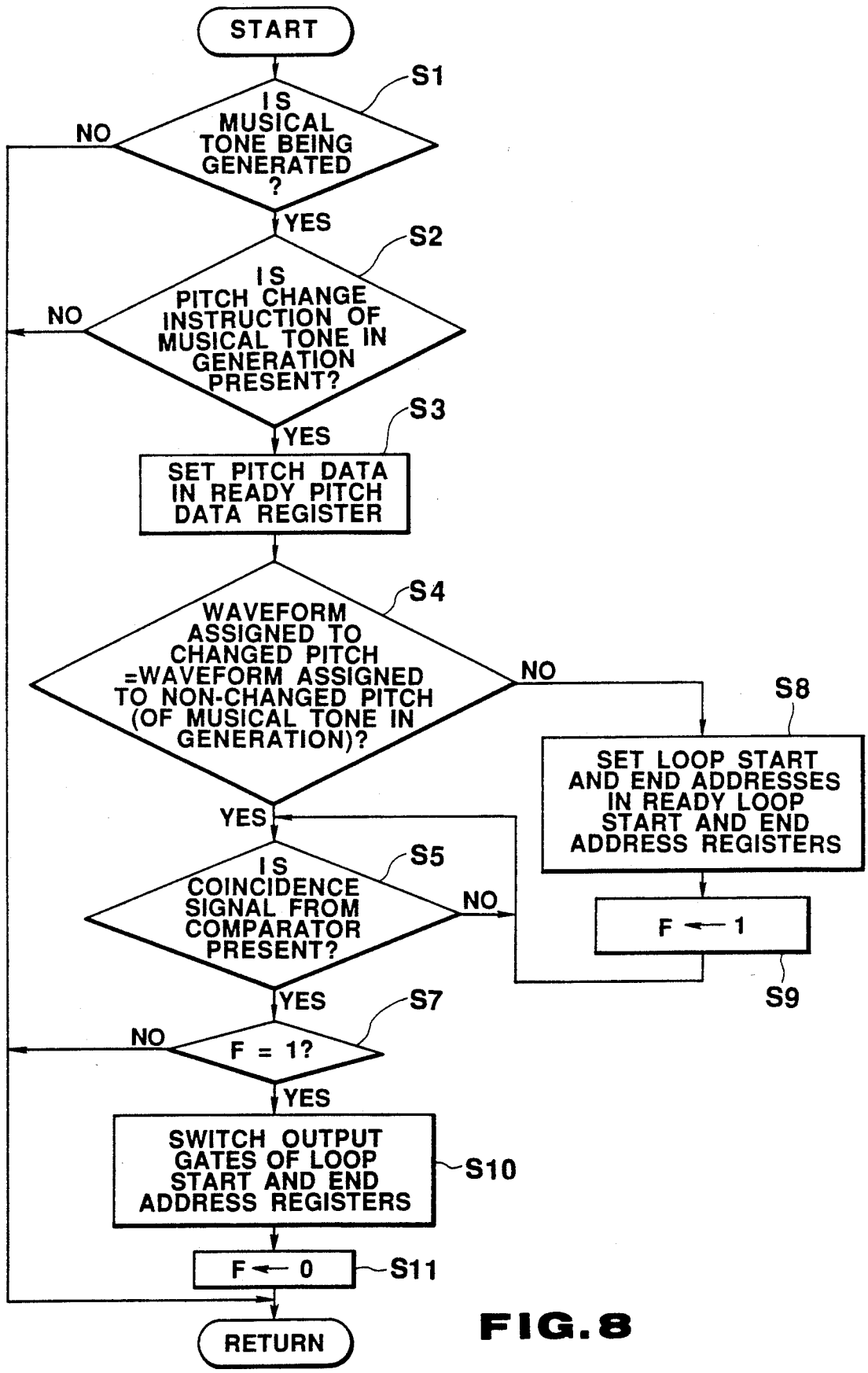
FIG. 8 is a flow chart for explaining pitch change control processing of a CPU 1 in the second embodiment.

The operation of the electronic wind instrument according to the second embodiment will be described below with reference to FIG. 7 on the basis of the flow chart of FIG. 8 showing a pitch change control processing operation for a musical tone in generation by the CPU 1. In FIG. 8, the same step numbers as in FIG. 6 of the first embodiment designate processing steps having the same functions, and only a difference will be described below.

A difference between the flow charts of FIGS. 6 and 8 is that processing in step S6 in FIG. 6 is not performed in FIG. 8. More specifically, output gate switching processing of the pitch data register PD is not performed. During generation of a musical tone signal by a PCM musical tone generator 7, if it is determined in step S2 that an instruction for changing a pitch of the musical tone signal is received, changed pitch data is set in the pitch data register PD to change the pitch at that instance. Thereafter, processing operations in steps S7 to S11 described above are executed, and a waveform to be read out at a timing of a loop end address is changed as needed.

When a performance for changing a pitch is made during generation of a musical tone, the electronic wind instrument according to the second embodiment immediately changes only the pitch, and then changes a waveform after read access up to the loop end address is completed if a waveform assigned to a pitch to be changed in the PCM waveform memory 8 must be changed according to a change in pitch.

Therefore, according to the second embodiment, a tone color can be naturally changed before and after a pitch is changed.

THIRD EMBODIMENT

Arrangement

Figure 9:
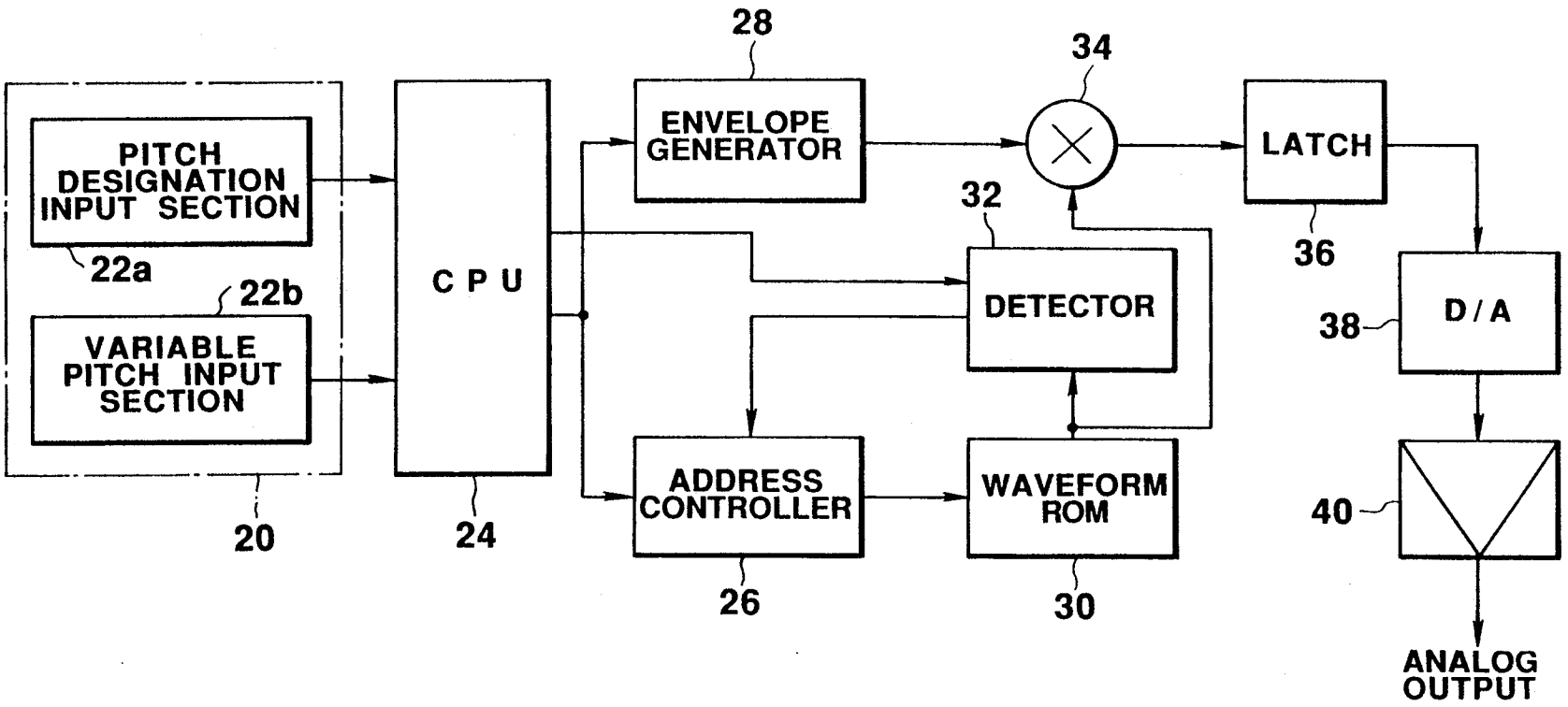
FIG. 9 is a block diagram of the third embodiment of the present invention.

FIG. 9 is a block diagram of a musical tone signal generating apparatus for an electronic musical instrument according to the third embodiment of the present invention. An input circuit 20 comprises a pitch designation input section 22*a*, and a variable pitch input section 22*b*. If an electronic musical instrument of this embodiment is a keyboard instrument, the pitch designation input section 22*a* is a keyboard; if it is a wind instrument, a guitar, or the like, the section 22*a* is an input section such as corresponding switches or frets for inputting pitches. The variable pitch input section 22*b* is, e.g., a switch, a bender, various sensors, or the like for changing and inputting a pitch of a musical tone in generation, and for designating to switch a waveform of a pitch of a musical tone in generation. The outputs from the pitch designation input section 22*a* and the variable pitch input section 2*b* are input to a CPU 24 as a control circuit. The output from the CPU 24 is supplied to an address controller 26 and an envelope generator 28. The output from the address controller 26 is supplied to a waveform memory (waveform ROM) 30.

The envelope generator 28 generates envelope data for changing an amplitude of an output musical tone along with a time. The waveform ROM 30 stores waveforms in units of predetermined tone range (e.g., in units of octaves), e.g., stores a waveform A, waveform B, . . . , as will be described later. The output from the waveform ROM 30 is input to a multiplier 34 together with the output from the envelope generator 28. A detector 32 detects according to the output from the CPU 24 whether or not the output from the waveform ROM 30 falls within a predetermined range allowing waveform switching. The detection result of the detector 32 is supplied to the address controller 26 and causes it to update an address of waveform data. The product from the multiplier 34 is output to a latch 36, and is also supplied to a D/A converter 38. The analog signal output from the D/A converter 38 is amplified by an amplifier 40, and is output from a loudspeaker (not shown), or the like.

Figure 10:
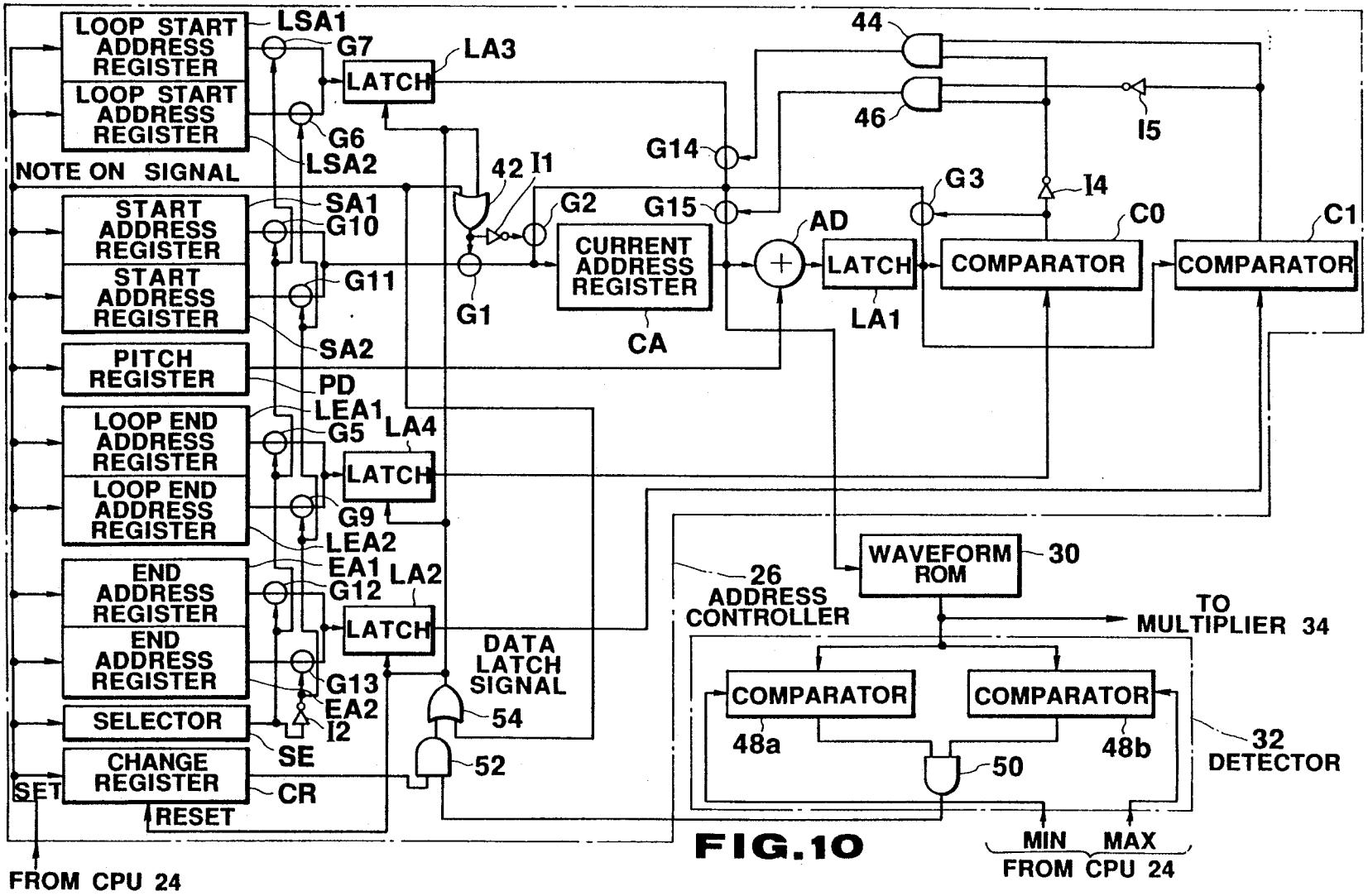
FIG. 10 is a block diagram of an address controller shown in FIG. 9.

FIG. 10 shows the arrangements of the address controller 26, the waveform ROM 30, and the detector 32. The output of the CPU 24 is coupled to loop start address registers LSA1 and LSA2, start address registers SA1 and SA2, a pitch register PD, loop end address registers LEA1 and LEA2, end address registers EA1 and EA2, a selector SE, and a change register CR, thereby inputting corresponding data. The outputs from the start address registers SA1 and SA2 are input to a current address register CA through gates G10 and G11 which are controlled by the output from the selector SE and a gate G1 which is ON-controlled by an output from an OR gate 42. The output from the current address register CA and the output from the pitch register PD are input to an adder AD. The sum from the adder AD is output to a latch LA1. A current address as the output of the latch LA1 is input to a comparator C0. The outputs from the loop end address registers LEA1 and LEA2 are input to the comparator C0 through gates G5 and G9 controlled by an output of the selector SE and via a latch LA2. As a result, the output from the comparator C0 goes to "1" when the current address is smaller than the loop end address; otherwise, it goes to "0". The current address as the output of the latch LA1 is input to the current address register CA through a gate G3 which is controlled by the output from the comparator C0, and a gate G2 which is ON-controlled via the OR gate 42 and an inverter I1 (to be described later) when a note ON signal (one-shot signal) from the CPU 24 is OFF (at low level).

The output from the comparator C0 is input to one input terminal of an AND gate 44 and is also input to one input terminal of an AND gate 46 through an inverter I4. The other input terminal of the AND gate 44 receives the output from a comparator C1. The other input terminal of the AND gate 46 receives the output from the comparator C1 through an inverter I5. The comparator C1 receives the outputs from the end address registers EA1 and EA1 through gates G12 and G13 which are controlled by the output from the selector SE and via the latch LA2. The comparator C1 compares the outputs from the latches LA1 and LA2, and outputs "1" when the current address is smaller than the end address; otherwise, outputs "0".

The AND gates 44 and 46 are connected to gates G14 and G15 so as to selectively supply the outputs from the loop start address registers LSA1 and LSA2 and the outputs from the current address register CA to the current address register CA, respectively. Therefore, in a loop address control mode, the outputs from the loop start address registers LSA1 and LSA2 are input to the current address register CA through a gate G7 and the gate G5, and through the gates G14 and G15 via a latch LA3.

Note that the gates G10, G5, G12, and G7, and the gates G11, G9, G13, and G7 are ON-controlled by an output from the selector SE and an output from the selector SE through an inverter I2.

The output from the current address register CA is supplied to the waveform ROM 30. The output from the waveform ROM 30 is supplied to comparators 48*a* and 48*b* of the detector 32. These comparators 48*a* and 48*b* respectively compare a peak value of a waveform read out from the waveform ROM 30 with threshold values of minimum and maximum values MIN and MAX. The comparison results of the comparators 48*a* and 48*b* are input to an AND gate 50, and the output from the AND gate 50 is supplied to one input terminal of an AND gate 52.

The other input terminal of the AND gate 52 receives the output from the change register CR. The output from the AND gate 52 is supplied as a data latch signal to latches LA4, LA2, and LA3 through an OR gate 54. The data latch signal is also input to an OR gate 42 together with the note ON signal, and is also supplied to the change register CR as a reset signal. The OR gate 54 also receives the note ON signal, and in a note ON mode, the content of a register designated by the output from the selector SE is set in the latches LA3, LA4, and LA2.

Operation

Figure 11:
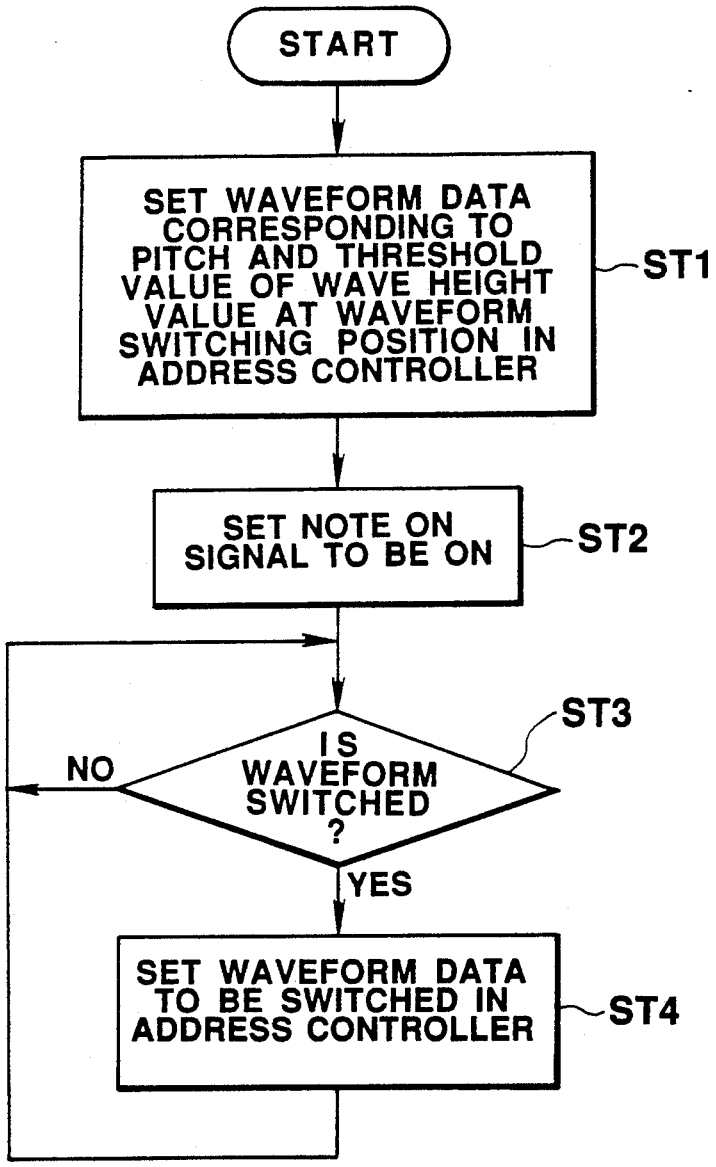
FIG. 11 is a waveform chart showing a waveform switching operation of the third embodiment.

The operation of the musical tone signal generating apparatus for an electronic musical instrument with the above arrangement will be described below with reference to the flow chart of FIG. 11.

Assume that a desired pitch is designated and input by the pitch designation input section 22*a*. As a result, data (parameter) for reading out waveform data corresponding to the designated pitch and wave height threshold values (MAX, MIN) of a switching position for switching a waveform are set in the address controller 26 (step ST1). More specifically, the CPU 24 determines waveform data to be read out in correspondence with the designated pitch input by the pitch designation input section 22*a*. As a result, the CPU 24 sets a parameter corresponding to the designated pitch in the address controller 26 so as to read out the corresponding waveform data.

When the designated pitch is present in a tone range covered by the waveform A, $LS_A$ is set in the loop start address register LSA1 of the address controller 26; $ST_A$, the start address register SA1; $LE_A$, the loop end address register LEA1; and $ED_A$, the end address register EA1. In addition, a selection signal "1" is set in the selector SE, and "0" is set in the change register CR. In order to determine a waveform peak value upon switching of a waveform on the basis of a designation input of the variable pitch input section 22*b*, minimum and maximum values (MIN, MAX) of a peak value are designated as threshold values of the peak value representing a range of allowing waveform switching at a waveform switching position, so that these values are ready to be output to the comparators 48*a* and 48*b*, respectively. In this case, the pitch register PD is set up with the designated specific pitch of the waveform A. The same setup is made as in the waveform A when a tone range corresponding to a designated pitch is the waveform B or other waveforms. The CPU 24 outputs a musical tone generation instruction signal (note ON signal) to the address controller 26 and the envelope generator 28 (step ST2).

When the note ON signal is output from the CPU 24, the gate G1 which is controlled by the note ON signal through an OR gate 42 is enabled in the address controller 26. Therefore, the output $ST_A$ from the start address register SA1 is input to the current address register CA through the gate G10 which is enabled in response to the selection signal from the selector SE. The output from the current address register CA is input to the adder AD together with the output from the pitch register PD. The sum is then output to the latch LA1. In response to the note ON signal, the OR gate 54 outputs a "1" signal, so that the contents of the registers LSA1, LEA1, and LE1, are set in the latches LA3, LA4, and LA2 through the gates G7, G9, and G12, respectively.

As a result, a value which is incremented and stored in the latch LA1 is equal to a sum of the output of the current address register CA and the pitch value output from the pitch register PD at a predetermined timing (sampling period) by the adder AD. The output of the latch LA1 incremented by the pitch value is supplied to the comparator C0, and is also fed back to the current address register CA through the gate G3 which is controlled by the output of the comparator C0 and the gate G2. As a result of comparison between the output of the latch LA1 and the output $LE_A$ of the latch LA4, if the current address does not reach the loop end address $LE_A$, the gate G3 is enabled in response to the output from the comparator C0. The gate G2 is enabled immediately after the gate G1 is enabled in response to the input note ON signal and the output from the start address register SA1 is input to the current address register CA. The current address stored in the latch LA1 is kept incremented by a loop of the latch LA1, the gates G3 and G2, the current address register CA, and the adder AD until the current address reaches the loop end address $LE_A$. The current address is supplied to the waveform ROM 30 as a read address. Since the incrementing rate of the current address is determined by the output from the pitch register PD, pitch control is realized.

When the output from the latch LA1 reaches the value $LE_A$ of the loop end address register LE1, the output from the comparator C0 disables the gate G3, and is input to one input terminal of each of the AND gates 44 and 46 through the inverter I4. The outputs from these AND gates 44 and 46 are determined by the output from the comparator C1. More specifically, the comparator C1 makes a comparison to determine if the current address latched by the latch LA1 has reached the output value $ED_A$ from the latch LA2. The output from the comparator C1 is input to the other input terminal of the AND gate 44, and is also input to the other input terminal of the AND gate 46 through the inverter I5. When the current address exceeds the loop end address $LE_A$, i.e., when it falls within the range between the loop end address $LE_A$ and the end address $ED_A$, the AND gate 44 outputs a loop end signal to enable the gate G14 to allow the output $LS_A$ already latched by the latch LA3 from the loop start address register LSA1 to pass through the gate G14. In this case, since no end signal is output from the AND gate 46, the gate G15 is kept disabled. More specifically, the output $LS_A$ of the latch LA3 is output to the current address register CA through the gates G14 and G2. Therefore, when the current address reaches the loop end address $LE_A$, it returns to the loop start address $LS_A$ to form a loop interval ($LS_A$ to $LE_A$). In this manner, addressing is repeated with this interval to continuously output a musical tone. Therefore, of the waveform A between the start and end addresses $ST_A$ and $ED_A$, a waveform portion between the start address $ST_A$ and the loop end address $LE_A$ is read out, and the loop interval up to the loop end address $LE_A$ is repetitively read out as long as a musical tone continues. When a musical tone is to be muted, a waveform portion up to the end address $ED_A$ is read out to end generation of a musical tone. In this case, for example, the address data output from the latch LA4 can be rewritten with a value indicating the end address $ED_A$. When the current address reaches the end address $ED_A$, a "0" output is supplied from the comparator C1 to enable the gate G15. As a result, the output from the current address register CA merely loops through the gates G15 and G2, and is no longer incremented. In this case, the gate G3 is disabled since the output from the comparator C0 goes to "0".

During generation of a musical tone, a waveform read out from the waveform ROM 30 is supplied to the multiplier 34. A predetermined envelope generated by the envelope generator 28 which received the note ON signal from the CPU 24 is supplied to the multiplier 34. As a result, the waveform read out from the waveform ROM 30 is multiplied with the predetermined envelope generated by the envelope generator 28 by the multiplier 34, and the product is then output through a latch 36 or the like.

After the note ON signal is output in step ST2, it is checked if a waveform (waveform A) is switched in response to an instruction to change a pitch of a musical tone in generation, i.e., a frequency upon operation of the variable pitch input section 22*b* (step ST3). The change in pitch is detected by monitoring the variable pitch input section 22*b* by the CPU 24. In step ST3, the same judgment is made until the pitch is considerably changed, i.e., a waveform of a musical tone in generation is switched. Although not shown, other processing is inserted between steps ST2 and ST3, as needed. For example, frequency change processing in a tone range corresponding to a certain waveform is executed. In this case, corresponding pitch data can be sequentially input to the pitch register PD.

If it is determined in step ST3 that the pitch is considerably changed and a waveform must be switched, the flow advances to step ST4, and a waveform address of waveform data to be switched (waveform B in this case) is set in the address controller 26. More specifically, as waveform data of the waveform B, $LS_B$ is set in the loop start address register LSA2; $ST_B$, the start address register SA2; $LE_B$, the loop end address register LE2; and $ED_B$, the end address register EA2. In addition, a selection signal "0" different from that upon generation of a previous musical tone is set in the selector SE, i.e., a selection signal for ON-controlling the gates G6, G11, G9, and G13 is set in the selector SE through the inverter I2. In addition, the change register CR is set.

As a result, the waveform is switched according to the output from the detector 32. More specifically, the detector 32 determines if the wave height value of the waveform data of the waveform in generation (waveform A) falls within a predetermined range. More specifically, the comparators 48*a* and 48*b* make comparisons to determine if the wave height value of the waveform data in generation which is sequentially read out from the waveform ROM 30 falls within the range between the wave height threshold values of the waveform switching position designated in step ST1 described above. If the comparators 48*a* and 48*b* detect the relation of MIN $\leqq$ the wave height value of waveform data $\leqq$MAX, a switching enable signal is output to the AND gate 50. Note that the threshold values compared in the comparators 48*a* and 48*b* can be arbitrarily set or fixed. As the threshold values approach "0", unnaturalness upon switching (e.g., generation of noise) can be eliminated.

The output from the AND gate 50 is input to the AND gate 52 together with the output from the change register CR. In this case, since the output from the change register CR is ON, the AND gate 52 outputs a data latch signal. Thus, the data latch signal is output from the AND gate 52 to the OR gate 42 and the latches LA2, LA3, and LA4 through the OR gate 54, and the address data of the waveform data of the waveform B to be switched are output to the corresponding latches. More specifically, $ST_B$ is transferred from the start address register SA2 to the current address register CA through the gates G11 and G1, $LE_B$ is transferred from the loop end address register LE2 to the latch LA4 through the gate G9, $ED_B$ is transferred from the end address register EA2 to the latch LA2 through the gate G13, and $LS_B$ is transferred from the loop start address register LSA2 to the latch LA3 through the gate G6, thereby outputting data of the waveform B. In this case, the data latch signal is output from the AND gate 52, and the change register CR is reset.

Figure 12:
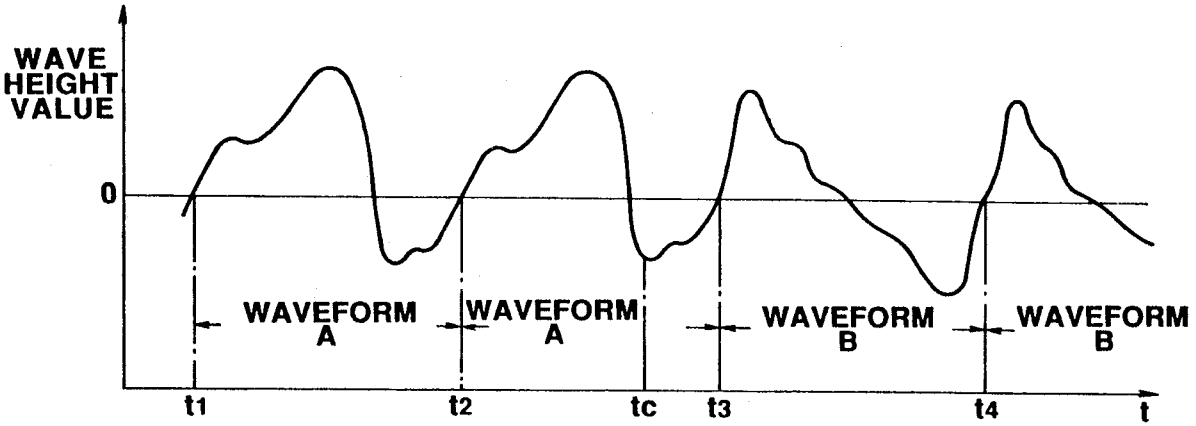
FIG. 12 is a flow chart showing an operation of the third embodiment.

For example, as shown in FIG. 12, the current waveform A of a musical tone in generation and the waveform B to be switched are stored in the waveform ROM 30, so that they start from a value "0" or a nearby value. FIG. 12 shows a waveform of one period. However, the waveforms A and B may consist of a plurality of periods. Before the end of the waveform A (time $t_c$), a pitch change instruction is issued from the CPU 24, and the change register CR is switched from "0" to "1". At the same time, address data indicating the waveform B to be switched are output to the corresponding latches, as described above. When the value of the waveform A falls within the range of the threshold values near "0" at time $t_3$, the data latch signal is output from the AND gate 52, and the waveform to be read out is switched to the waveform B. Thereafter, a musical tone is output with a pitch designated in a tone range of the waveform B.

In this manner, when different waveforms stored in the waveform ROM are switched, a waveform is switched if the value of waveform data of a musical tone in generation falls within the range of predetermined threshold value. Therefore the read timing of an optimal waveform can be smoothly changed according to a change in pitch by, e.g,. a portamento operation or a pitch bend operation.

FOURTH EMBODIMENT

In the above embodiment, a waveform is switched when a value of waveform data of a musical tone in generation falls within a range of predetermined threshold values. However, waveform data may be switched at a timing of reading out zero-level waveform data, i.e., a timing of reading out waveform data at a zero-crossing point (in FIG. 12, the loop end address coincides with one of zero-crossing points).

Arrangement

Figure 13:
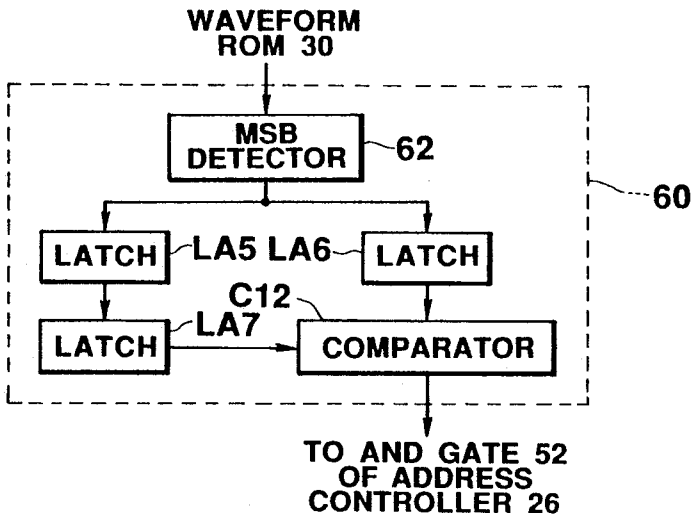
FIG. 13 is a block diagram showing a main part of the fourth embodiment of the present invention.

FIG. 13 is a block diagram of a detector as a principal part of this embodiment. In a simplest known method of detecting a zero-crossing point, it is checked if the positive/negative codes of two waveform data corresponding to two adjacent addresses of storage areas in a PCM waveform memory 30 are inverted.

Assume that waveform data is digital data expressed by a complementary number of 2, its MSB (most significant bit) is a code bit, and when the MSB="0", it indicates a positive value; when the MSB="1", it indicates a negative value.

As shown in FIG. 13, a detector 60 comprises an MSB detector 62 for detecting the MSB of waveform data in the waveform ROM 30, latches LA5 and LA6 for latching a code bit from the MSB detector, a latch LA7 for latching the output from the latch LA5, and a comparator C2 for comparing the outputs from the latches LA7 and LA6.

Operation

The code bit as the MSB of the waveform data from the waveform ROM 30 is latched by the latches LA5 and LA6. When the next waveform data is read out, new MSB data is latched by the latches LA5 and the LA6, and the latch LA7 latches the immediately preceding code bit previously latched by the latch LA5. The comparator C2 compares the contents of the latches LA6 and LA7, i.e., a code bit of waveform data currently read out from the waveform ROM 30 and the immediately preceding code bit. When a coincidence between the two bits is found, i.e., when a zero-crossing point is not detected, the comparator C2 outputs "0"; when a noncoincidence between the two codes is found, i.e., when a zero-crossing point is detected, it outputs "1".

This output is input to the AND gate 52 of the address controller 26 shown in FIG. 10. When the output from the comparator C2 is "1", the waveform data switching operation is executed, as described above.

In this manner, waveforms can be smoothly connected.

FIFTH EMBODIMENT

Arrangement

Figure 14:
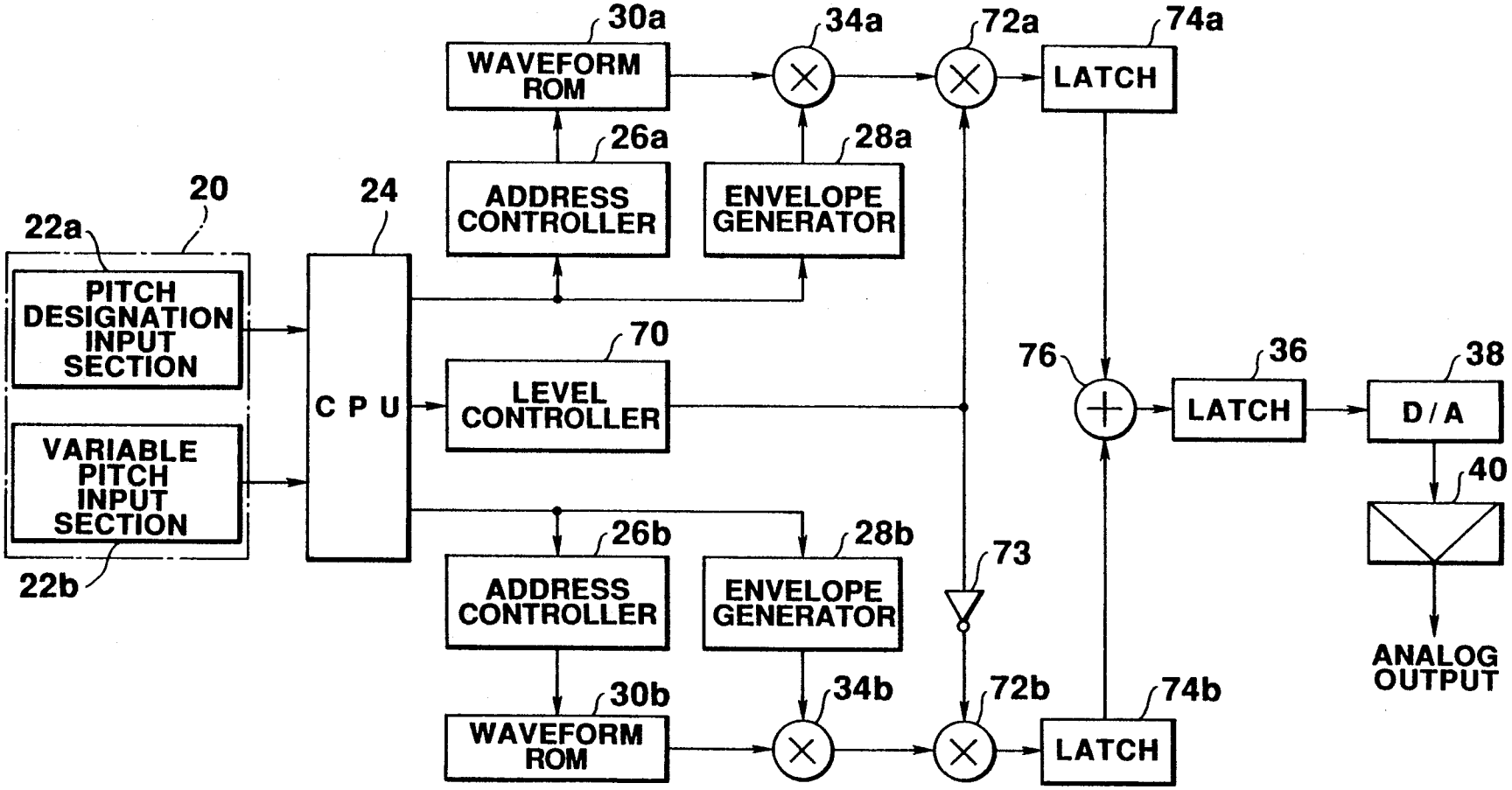
FIG. 14 is a block diagram of the fifth embodiment of the present invention.

FIG. 14 is a block diagram of a musical tone signal generating apparatus according to the fifth embodiment of the present invention. An input circuit 20 comprises a pitch designation input section **22*a*, and a variable pitch input section 22*b*. If an electronic musical instrument of this embodiment is a keyboard instrument, the pitch designation input section 22*a* is a keyboard; if it is a wind instrument, a guitar, or the like, the section 22*a* is an input section such as corresponding switches or frets for inputting pitches. The variable pitch input section 22*b* is, e.g., a switch, a bender, various sensors, or the like for changing and inputting a pitch of a musical tone in generation, and for designating to switch a waveform of a pitch of a musical tone in generation. The outputs from the pitch designation input section 22*a* and the variable pitch input section 22*b* are input to a CPU 24 as a control circuit. The output from the CPU 24 is supplied to a level controller 70 for cross-fade controlling a level of an amplitude of an output waveform according to the designated pitch (to be described later), and is also supplied to address controllers 26*a* and 26*b* and envelope generators 28*a* and 28*b*. The outputs from the address controllers 26*a* and 26*b* are respectively supplied to waveform memories (waveform ROMs) 30*a* and 30*b***.

The envelope generators **28*a* and 28*b* generate envelope data for changing an amplitude of an output musical tone along with time. The waveform ROMs 30*a* and 30*b* store waveforms including loop portions in units of predetermined tone range (e.g., in units of octaves). The output from the waveform ROM 30*a* is input to a multiplier 34*a* together with the output from the envelope generator 28*a*, and a product from the multiplier 34*a* is input to a multiplier 72*a*. The multiplier 72*a* receives the product from the multiplier 34*a*, and the output from the level controller 70. On the other hand, the output from the waveform ROM 30*b* is input to a multiplier 34*b* together with the output from the envelope generator 28*b*, and a product from the multiplier 34*b* is input to a multiplier 72*b*. The multiplier 72*b* receives the product from the multiplier 34*b* and the inverted output of the level controller 70 through an inverter 73**.

The products from the multipliers **72*a* and 72*b* are respectively supplied to latches 74*a* and 74*b*, and are then output to an adder 76. The sum from the adder 76 is output to a latch 36, and is then supplied to a D/A converter 38. The analog signal from the D/A converter 38 is amplified by an amplifier 40**, and is then output from a loudspeaker (not shown).

Figure 15:
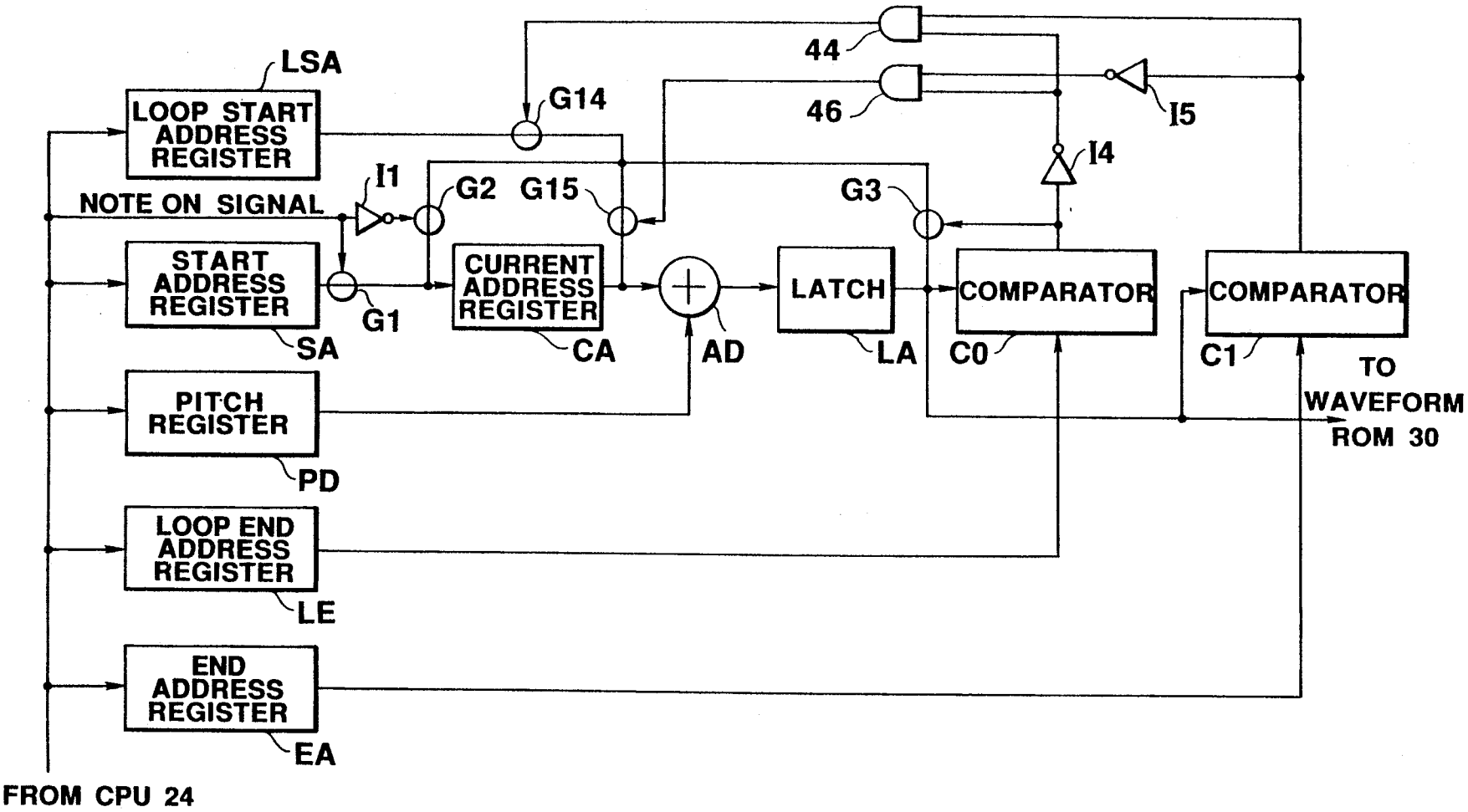
FIG. 15 is a block diagram of an address controller shown in FIG. 14.
Figure 18:
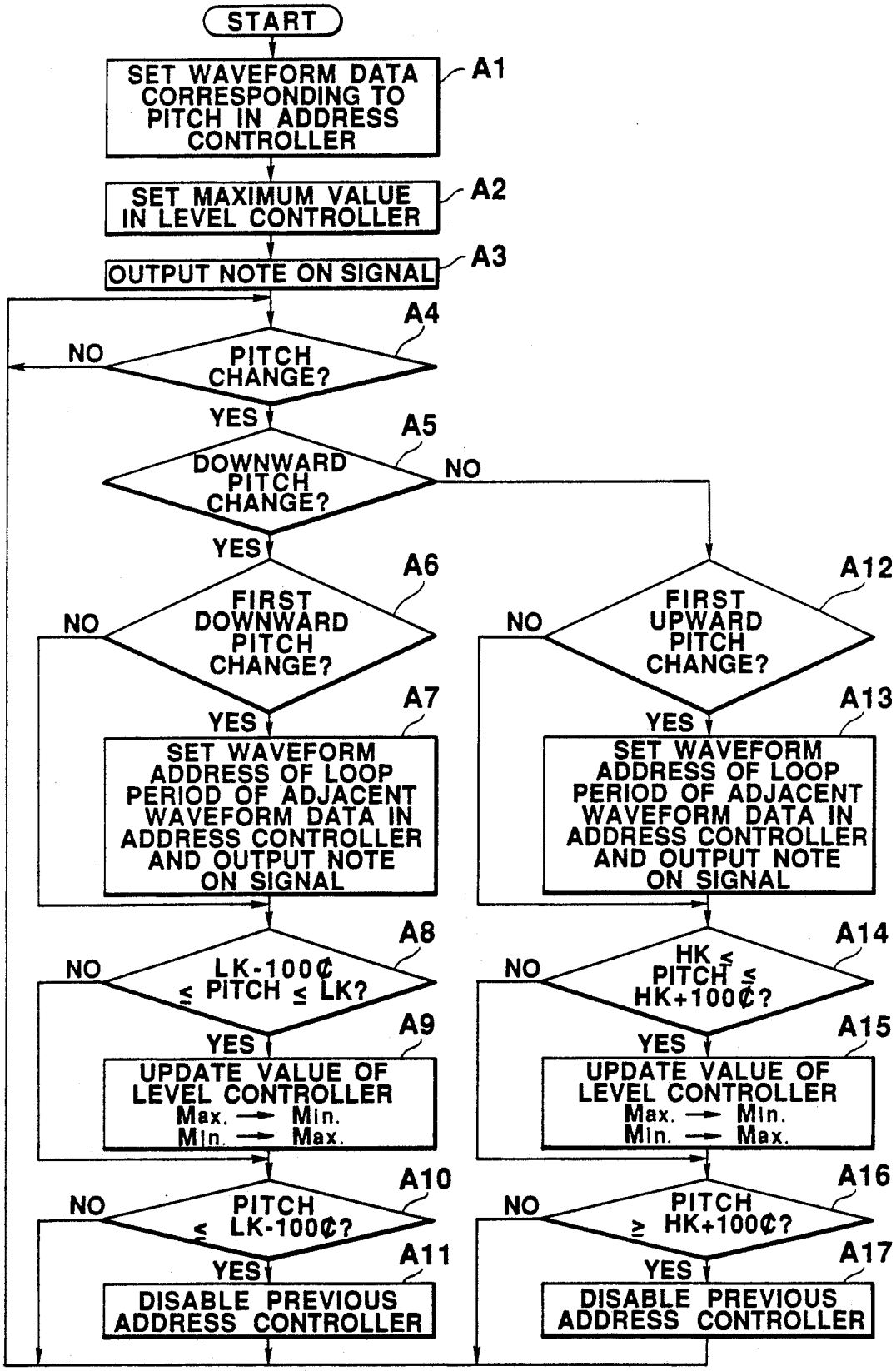
FIG. 18 is a flow chart showing an operation of the fifth embodiment of the present invention.

FIG. 15 shows, e.g., the address controller 26*a*. The output of the CPU 24 is connected to a loop start address register LSA, a start address register SA, a pitch register PD, a loop end address register LE, and an end address register EA. The output from the start address register SA is input to a current address register CA through a gate G1 which is controlled by the output from the CPU 24. The output from the current address register CA and the output from the pitch register PD are input to an adder AD. The sum from the adder AD is then output to a latch LA. A current address as the output of the latch LA is input to a comparator C0 together with the output from the loop end address register LEA. When the current address is smaller than the loop end address, the output of the comparator C0 goes to "1"; otherwise, it goes to "0". The output from the latch LA is input to the current address register CA through a gate G3 which is controlled by the output from the comparator C0 and a gate G2 which is ON-controlled through an inverter I1 when a note ON signal (one-shot signal) from the CPU 24 is OFF (at low level).

The output from the comparator C0 is input to an AND gate 44 together with the output from a comparator C1 via an inverter I4. The comparator C1 compares the output from the latch LA and the output from the end address register EA. When the current address is smaller than the end address, the output of the comparator C1 goes to "1"; otherwise, it goes to "0". The output from the comparator C1 through an inverter I5 is input to an AND gate 46 together with the output from the comparator C0 through the inverter I4. The AND gates 44 and 46 are connected to gates G14 and G15 so as to supply the output from the loop start address register LSA and the output from the current address register CA to the current address register CA. Therefore, the output from the loop start address register LSA is input to the current address register CA through the gates G14 and G2.

The detailed arrangement of the address controller 26*a* has been described above. Since the address controller 26*b* has the same arrangement as the controller 26*a*, a detailed description thereof will be omitted.

FIGS. 16A and 16B show waveforms stored in the waveform ROMs 30*a* and 30*b*. In this case, the waveform ROMs 30*a* and 30*b* alternately store waveforms of adjacent tone ranges in units of octaves. As will be described later, the waveform ROM 30*a* stores waveform data 2 and 4, and the waveform ROM 30*b* store waveform data 1 and 3 (FIG. 17). FIGS. 16A and 16B show waveforms of adjacent tone ranges. Time is plotted along the abscissa, and an amplitude is plotted along the ordinate. $ST_2$, $ST_1$, $LS_2$, $LS_2$, $LE_2$, $LE_1$, $ED_2$, and $ED_1$ respectively indicate the start, loop start, loop end, and end addresses stored in the registers SA, LSA, LE, and EA. Attack portions with emphasized tone quality are included between the start addresses $ST_2$ and $ST_1$ and the loop start addresses $LS_2$ and $LS_1$, of the waveforms 2 and 1, as shown in FIGS. 16A and 16B, and are also included between the start addresses and the loop start addresses of the waveforms 3 and 4.

FIG. 17 shows the relationship among adjacent tone range. For example, a range corresponding to pitches $C_3$ to $B_3$ is determined as the waveform 1, a range corresponding to pitches $C_4$ to $B_4$ is determined as the waveform 2, a range corresponding to pitches $C_5$ to $B_5$ is determined as the waveform 3, and a range corresponding to pitches $C_6$ to $B_6$ is determined as the waveform 4. These items of waveform data are used for ranges designated by a low-key position (LK) and a high-key position (HK). More specifically, in the waveform 1, a pitch $C_3$ corresponds to LK1 and a pitch B3 corresponds to $HK_1$. Similarly, in the waveform 2, a pitch $C_4$ corresponds to $LK_2$ and a pitch $B_4$ corresponds to $HK_2$. The same applies to other waveforms. Each waveform is addressed by the start address (ST), the end address (ED), the loop start address (LS), and the loop end address (LE). A pitch between the pitches $B_3$ and $C_4$ is output under the cross-fade control so that the levels of the waveforms 1 and 2 cross each other. More specifically, as the level of the waveform 1 gradually increases or decreases, the level of the waveform 2 gradually decreases (or increases) accordingly. In this manner, an interval wherein levels of two adjacent waveforms are changed is determined as a cross-fade interval. In this case, the cross-fade interval is determined to be 100¢(cent) to have widths of 50¢ from a point at which levels (mixing ratios) of the adjacent waveforms are equal to each other. Note that in FIG. 17, a 100¢ interval between the pitches $B_3$ and $C_4$ is determined as the cross-fade interval. However, the width of this interval is not limited to 100¢. The inclination of the mixing levels representing that cross-fade control is made within 100¢ determined based on the output from the level controller 70.

Operation

The pitch designation input section 22*a* designates and inputs a desired pitch. As a result, data (Parameter) for reading out the waveform data corresponding to the designated pitch is set in the address controllers 26*a* and 26*b* (step A1). The CPU 24 determines one of the waveform data 1 to 4 to which the pitch designated and input by the pitch designation input section 22*a* belongs. In this case, since the waveform ROMs 30*a* and 30*b* alternately store waveform data of adjacent tone ranges in units of octaves, the CPU 24 also determines, based on the designated pitch, a waveform ROM from which a waveform is to be read out. Parameters corresponding to the designated pitch are set in the address controllers 26*a* and 26*b* so as to read out the corresponding waveform data.

For example, if the designated pitch is present in the tone range of the waveform 2, $LS_2$, $ST_2$, $LE_2$, and $ED_2$ are respectively set in the loop start address register LSA, the start address register SA, the loop end address register LE, and the end address register EA of the address controller 26*a*. If the designated pitch belongs to the range of the waveform 1, $LS_1$, $ST_1$, $LE_1$, and $ED_1$ are respectively set in the loop start address register, the start address register, the loop end address register, and the end address register of the address controller 26*b* in the same manner as the address controller 26*a*. When another pitch designation is made, corresponding parameters are set in the address controller 26*a* or 26*b* so that data of the waveform 4 is read out by the address controller 26*a* or data of the waveform 3 is read out by the address controller 26*b*, and waveform data of non-adjacent tone ranges are read out in units of octaves.

In this case, an input specific one of the pitches $C_4$ to $B_4$ of the waveform 2 is set in the pitch register PD. A maximum value of a level is set in the level controller 70 to maximize the amplitude of the waveform (step A2).

More specifically, the multiplier 72*a* receives the maximum value from the level controller 70, and the multiplier 72*b* receives a minimum value (0) obtained by inverting the output from the level controller 70 by the inverter 73. The CPU 24 outputs a musical tone generation instruction signal (note ON signal) to the address controller 26*a* and the envelope generator 28*a* (step B3). Note that when the tone range corresponding to the designated pitch is the waveform 1 or 3, the minimum value is set in the level controller 70 to output the waveform in the waveform ROM 30*b* at the maximum level.

When the note ON signal is output from the CPU 24, the gate G1 is enabled and the output $ST_2$ is input from the start address register SA to the current address register CA in address controller 26. The output from the current address register CA is input to the adder AD together with the output from the pitch register PD. The sum from the adder AD is output to the latch LA.

A value which is incremented and stored in the latch LA is equal to the sum of the output from the current address register CA and the pitch value output from the pitch register PD by the adder AD at a predetermined timing (sampling period). The output from the latch LA incremented by the pitch value is supplied to the comparator C0, and is fed back to the current address register CA through the gate G controlled by the output from the comparator C0 and the gate G2. As a result of comparison between the output from the latch LA and the output $LE_2$ from the loop end address register LE, if the current address does not reach the loop end address $LE_2$, the gate G2 is enabled by the output from the comparator C0. The gate G2 is enabled immediately after the gate G1 is enabled in response to the note ON signal and the output from the start address register SA is input to the current address register CA. Thus, the current address stored in the latch LA is kept incremented by a loop of the latch LA, the gates G3 and G2, the current address register CA, and the adder AD until the current address in the latch LA reaches the loop end address $LE_2$. The current address is supplied to the waveform ROM 30*a* as a read address. Since the incrementing rate of the current address is determined by the output from the pitch register PD, pitch control can be realized.

When the output from the latch LA reaches the value $LE_2$ of the loop end register LE, the output from the comparator C0 disables the gate G3, and is input to one input terminal of each of the AND gates 44 and 46 via the inverter I4. The outputs from the AND gates 44 and 46 are determined by the output from the comparator C1. More specifically, the comparator C1 makes a comparison to determine whether or not the current address stored in the latch LA has reached the output value $ED_2$ from the end address register EA. This output is input to the other input terminal of the AND gate 44, and is also input to the other input terminal of the AND gate 46 through an inverter I5. When the current address falls within the range of the loop end address $LE_2$ and the end address $ED_2$, the AND gate 44 outputs a loop end signal to enable the gate G14 so as to allow the output $LS_2$ of the loop start address register LS to pass the gate G14. Since no end signal is output from the AND gate 46, the gate G15 is kept disabled. More specifically, the output $LS_2$ of the loop start address register LS is output to the current address register CA through the gates G14 and G2. When the current address reaches the loop end address $LE_2$, it returns to the loop start address $LS_2$ to form a loop period ($LS_2$ to $LE_2$). In this manner, addressing in this loop period is repeated to continuously output a musical tone. Therefore, of the waveform 2 in FIG. 16A between the start and end addresses $ST_2$ and $ED_2$, a waveform portion between the start address $ST_2$ and the loop end address $LE_2$ is read out, and the loop period up to the loop start address $LE_2$ is repetitively read out according to a duration of a musical tone as long as the musical tone continues. When a musical tone is to be muted, a waveform portion up to the end address $ED_2$ is read out to end generation of a musical tone. In this case, for example, the content of the loop end address register LE can be rewritten with the end address $ED_2$. When the current address reaches the end address $ED_2$, a "0" output is supplied from the comparator C1 to enable the gate G15. As a result, the output from the current address register CA merely loops through the gates G15 and G2, and an address is no longer incremented. In this case, the gate G3 is disabled since the output from the comparator C0 goes to "0".

During generation of a musical tone, waveform data read out from the waveform ROM 30*a* is supplied to the multiplier 34*a*. Predetermined envelope data generated by the envelope generator 28*a* which received the note ON signal from the CPU 24 is supplied to the multiplier 34*a*. As a result, the waveform data read out from the waveform ROM 30*a* is multiplied with the predetermined envelope data generated by the envelope generator 28*a* by the multiplier 34*a*, and the product is then output to the multiplier 72*a*. As described above, the maximum value is multiplied with the output from the multiplier 34*a* by the multiplier 72*a*, and the product is then output through the adder 76, the latch 36, and the like.

After the note ON signal is output in step A3, it is checked if a control signal is input to change a pitch of a musical tone in generation, i.e., frequency by the variable pitch input section 22*b* (step A4). The change in pitch can be detected by monitoring the variable pitch input section 22*b* by the CPU 24. In step A4, the same judgment is made until the pitch is changed. Although not shown, other processing is inserted between steps A3 and A4, as needed. If the pitch is changed, it is checked if the pitch is changed upward or downward from the current pitch (step A5). If it is determined in step A5 that the pitch is changed downward, the flow advances to step A6 to check if the pitch is changed downward for the first time. If YES in step A6, the flow advances to step A7, and waveform addresses of the loop section of waveform data adjacent to the tone range of the waveform 2 are set in the address controller 26*b* in this case.

In this case, the address controller 26*a* is operated in the same manner as the address controller 26*a* to read out the loop period of waveform data adjacent to the tone range of the waveform 2. Thus, waveform data of the loop period of the adjacent tone range (waveform 1 in this case) is read out to the address controller 26*a*. Thus, the loop start address $LS_1$ is set in the start address register. In this case, waveform data in the loop period of the waveform 1 between the loop start address LS1 and the loop end address $LE_1$ shown in FIG. 16B is read out from the waveform ROM 30*b*. The waveform data of the loop period of the waveform 1 read out from the waveform ROM 30*b* by the address controller 26*b* is supplied to the multiplier 34*b*. Furthermore, a predetermined envelope data generated by the envelope generator 28b which received the note ON signal from the CPU 24 is supplied to the multiplier 34b. Thus, the predetermined envelope data generated by the envelope generator 28b is multiplied with the waveform data read out from the waveform ROM 30b by the multiplier 34b, and the product is then output to the multiplier 72b. If it is determined in step A6 that the pitch is changed for the second time or thereafter, the flow advances not to step A7 but to step A8.

A change in pitch is determined in step A8. In this case, since the pitch of the low key $LK_2$ is $C_4$, it is checked if the pitch is present between the pitches $B_3$ and $C_4$, i.e., if $LK - 100¢ \leqq pitch \leqq LK$ is satisfied. If NO in step A8, the flow advances to step A10 (to be described later). However, if YES in step A8, i.e., a pitch is continuously changed by a portamento or pitch bend operation, the flow advances to step A9 to mix waveforms under the cross-fade control. More specifically, the value of the level controller 70 is updated.

Since the value of the level controller 70 is changed depending on a pitch, a mixing ratio of the waveform data 1 and 2 is determined depending on a pitch in this case. Therefore, if the pitch is $C_4$ or more, a musical tone is generated using only the waveform data 2, as described above. However, if the pitch is changed from $C_4$ toward $B_3$, the level of the waveform 2 is changed from the maximum value to the minimum value, while the level of the loop period of the waveform data 1 is changed from the minimum value to the maximum value, thus achieving the cross-fade control. Since the level controller 70 supplies its output to the multiplier 72b, and the multiplier 72b receives the output inverted by the inverter 73, if one level is increased, the other level is complementarily decreased. As a result, the level of a musical tone of the waveform 2 is decreased, and the level of a musical tone of the waveform 1 which consists of only the loop period and does not include an attack portion with emphasized tone quality is increased, that is, waveforms are switched, thus naturally changing musical tones. In this manner, every time a change in pitch is detected in step A4, steps A5, A6, A8, and A9 are executed, and a series of processing operations are repeated until step A10 is satisfied.

In step A10, a change in pitch is judged again to check if a pitch $\leqq LK2 - 100$ ¢. In this case, when another waveform is switched after the cross-fade control is made in step A9, e.g., after a tone range is switched from that of the waveform 2 to that of the waveform 1, YES is determined in step A10, and the flow advances to step A11. In this case, NO is determined in step A8, as a matter of course. In step A11, the previous address controller (26a in this case) is set OFF, i.e., initialized. Thereafter, the waveform 1 is output with the designated pitch.

In contrast to this, if an upward pitch change is detected in step A5, the flow advances to step A12 to check if the pitch is changed upward for the first time. If YES in step A12, the flow advances to step A13, parameters are set in the address controller 26b to read out waveform data adjacent to the tone range of the waveform 2, in this case, the waveform of the loop period of the waveform 3, and the note ON signal is output in the same manner as for the waveform 2. If NO in step A12, the flow advances not to step A13 but to step A14.

In step A14, a change in pitch is determined. In this case, since the high key $HK_2$ is $B_4$, it is checked if a pitch is present between $B_4$ and $C_5$, i.e., if $HK \leqq pitch \leqq HK + 100¢$ is satisfied. If NO in step A14, the flow advances to step A16 (to be described later). However, if YES in A14, the flow advances to step A15 to perform mixing control under the cross-fade control. More specifically, the value of the level controller 70 is changed depending on the pitch. In this case, the mixing ratio of the waveform and the loop period of the waveform 3 is determined depending on the pitch. Therefore, as the pitch is changed from $B_4$ toward $C_5$, the level of the waveform 2 is changed from the maximum value to the minimum value, while the level of the waveform of the loop period of the waveform 3 to be mixed under the cross-fade control is changed from the maximum value to the minimum value. The level of a musical tone of the waveform 2 is decreased, and the level of a musical tone of the waveform of the loop interval of the waveform 3 is increased, thus switching the waveforms.

In step A16, a change in pitch is judged in the same manner as in step A10. In this case, it is checked if the pitch $\geqq HK2 + 100¢$. After the cross-fade processing is executed to switch waveform to another one in step A15, i.e., after the tone range is switched from that of the waveform 2 to that of the waveform 3, the flow advances to step A17. In step A17, the previous address controller (26a in this case) is set OFF, i.e., initialized. Thereafter, only the waveform data 3 is output with the designated pitch.

When a pitch is changed outside a tone range of a musical tone in generation, a musical tone is reproduced while executing the cross-fade processing between the waveform of a tone range of a musical tone in generation and a waveform portion of a loop period of a waveform of the adjacent tone range to be switched. For this reason, when a pitch is changed, waveforms can be smoothly switched in accordance with a change in pitch without reproducing a musical tone whose attack portion is emphasized.

In the first to fifth embodiments, a plurality of items of PCM waveform data are stored in the PCM waveform memory by dividing areas. However, the PCM waveform memory may store only one PCM waveform data common to all the tone range. When a performance requiring a change in pitch is made during generation of a musical tone signal by the PCM musical tone generator 7, a pitch may be changed after read access of waveform data progresses to a timing of a loop end address as in the first embodiment without immediately changing the pitch as in the second embodiment. Thus, a pitch can be changed without causing an instantaneous unnecessary change in tone color.

The present invention can be applied to any other apparatuses which express waveforms without using the PCM technique. For example, a differential PCM method, an adaptive differential PCM method, a delta modulation method, and the like may be employed.

In the third and fourth embodiments described above, waveform data previously read out from the waveform ROM is determined as the waveform A, and waveform data to be switched is determined as the waveform B. However, the present invention is not limited to this. Arbitrary waveform data can be read out, as a matter of course.

In the fifth embodiment described above, items of waveform data of adjacent tone ranges are alternately stored in two waveform ROMs in units of octaves. However, these waveform ROMs may store waveforms of all the tone ranges. In this case, for example, the address controller 26a can be started first for any range.

The two systems of musical tone generators are not limited to the embodiments described above, but may be realized by time-divisionally using two channels of a multichannel sound source. That is, at least two musical tone generation channels need only be prepared to generate one tone, and the structure of each musical tone generation channel is not limited.

Envelope control by the envelope generator may be performed after the adder 76 in FIG. 14. In this case, one envelope generator can be used, thus further simplifying the arrangement.

Additional advantages and modifications will readily occur to those skilled in the art. Therefore, the invention in its broader aspects is not limited to the specific details, representative devices, and illustrated examples shown and described. Accordingly, departures may be made from such details without departing from the spirit or scope of the general inventive concept as defined by the appended claims and their equivalents.

What is claimed is:

1. A musical tone signal generating apparatus comprising:

memory means for storing different waveform data in correspondence with a plurality of different tone ranges;

pitch designation means for designating a pitch of a musical tone;

waveform designation means for designating, from said memory means, waveform data corresponding to a tone range to which the pitch designated by said pitch designation means belongs;

readout means for reading out the waveform data designated by said waveform designation means at a frequency corresponding to the pitch designated by said pitch designation means;

musical tone signal output means for generating a musical tone signal on the basis of the waveform data read out by said readout means;

timing signal generation means, operative when a current pitch of a musical tone signal in generation is changed by said pitch designation means to a new pitch belonging to a new tone range different front a current tone range to which the current pitch belongs, for generating a switching timing signal; and switching means for causing said readout means to read out waveform data corresponding to the new tone range to which the new pitch designated by said pitch designation means belongs in response to the switching timing signal generated by said timing signal generation means.

2. An apparatus according to claim 1, wherein said timing signal generation means includes means for detecting whether or not a value of the waveform data read out from said memory means falls within a predetermined range, and outputting the switching timing signal when the value of the waveform data falls within the predetermined range.

3. An apparatus according to claim 1, wherein said pitch designation operation means comprises pitch designation means for designating a pitch corresponding to a scale, and variable input means for varying a pitch of a musical tone in generation.

4. An apparatus according to claim 1, wherein said timing signal generation means outputs the switching timing signal by detecting a timing when said readout means reads out zero-level waveform data point.

5. An apparatus according to claim 1, wherein said memory means stores pulse-code modulated waveform data.

6. A musical tone signal generating apparatus for an electronic musical instrument, comprising:

memory means for storing a plurality of different items of waveform data in correspondence with a plurality of different tone ranges, each waveform data having a loop portion to be repeatedly read out;

pitch designation operation means for designating a pitch of a musical tone;

readout means for designating and reading out, from said memory means, waveform data corresponding to a tone range to which the pitch designated by said pitch designation operation means belongs;

musical tone signal generation means for generating a musical tone signal on the basis of the waveform data read out by said readout means;

timing signal generation means, operative when said pitch designation operation means is operated to change a current pitch of a musical tone signal in generation to a new pitch belonging to a new tone range different from a current tone range to which the current pitch belongs, for generating a switching timing signal when waveform data at a lop end address of said loop portion is read out from said memory means; and waveform switching means for causing said readout means to designate and read out waveform data corresponding to the tone range to which the new pitch designated by said pitch designation operation means belongs in response to the switching timing signal generated by said timing signal generation means.

7. An apparatus according to claim 6, wherein said memory means stores pulse-code modulated waveform data.

8. A musical tone signal generating apparatus for an electronic musical instrument, comprising:

memory means for storing a plurality of different items of waveform data in correspondence with a plurality of different tone ranges;

pitch designation operation means for designating a pitch of a musical tone;

readout means for designating and reading out, from said memory means, waveform data corresponding to a tone range to which the pitch designated by said pitch designation operation means belongs and at a speed corresponding to said pitch;

musical tone signal generation means for generating a musical tone signal on the basis of the waveform data read out by said readout means;

timing signal generation means, operative when said pitch designation operation means is operated to change a current pitch of a musical tone signal in generation to a new pitch belonging to a new tone range different from a current tone range to which the current pitch belongs, for generating a switching timing signal;

waveform switching means for causing said readout means to designate waveform data corresponding to the tone range to which the new pitch designated by said pitch designation operation means belongs in response to the switching timing signal from said timing signal generation means; and readout speed switching means for causing said readout means to change from the speed corresponding to the current pitch designated by said pitch designation operation means to a speed corresponding to the new pitch in response to the suitable timing signal from said timing signal generation means.

9. An apparatus according to claim 8, wherein each waveform data stored in said memory means has a loop portion for being repeatedly read out.

10. An apparatus according to claim 9, wherein said timing signal generation means outputs the switching timing signal when the waveform data at a loop end address is read out from said memory means.

11. An apparatus according to claim 8, wherein said memory means stores pulse-coded modulated waveform data.

12. A musical tone signal generating apparatus for an electronic musical instrument, comprising:

memory means for storing waveform data;

pitch designation operation means for designating a pitch of a musical tone;

readout means for reading out from said memory means, waveform data at a speed corresponding to a pitch designated by said pitch designation operation means;

musical tone signal generation means for generating a musical tone signal on the basis of the waveform data read out by said readout means;

timing signal generation means, for generating a switching timing signal when the waveform data at a specified address of said memory means is read out after said pitch designation operation means designates a new pitch; and readout speed switching means for causing said readout means to change from an operating speed corresponding to a current pitch designated by said pitch designation operation means to a speed corresponding to a new pitch in response to the switching timing signal for said timing signal generation means.

13. An apparatus according to claim 12, wherein each waveform data stored in said memory means has a loop portion repeatedly read out.

14. An apparatus according to claim 13, wherein said timing signal generation means outputs the switching timing signal when said readout means reads out waveform data at a loop end address from said memory means.

15. A musical tone signal generating apparatus comprising:

memory means for storing a plurality of different items of waveform data in correspondence with a plurality of different tone ranges;

pitch designation operation means for inputting a pitch of a musical tone which is variable continuously;

waveform designation means for designating, from said memory means, waveform data corresponding to a tone range to which the pitch designated by said pitch designation operation means belongs;

waveform readout-means, comprising two readout means, for always reading out waveform data from said memory means by one of said two readout means, and for, when new waveform data corresponding to a new tone range to which a new pitch designated by said pitch designation operation means belongs is different from current waveform data, reading out the new waveform data by the other of said two readout means;

amplitude control means for gradually decreasing a value of the current waveform data readout from said memory means by one of said two readout means to zero, and gradually increasing a value of the new waveform data readout from said memory means by the other of said two readout means to a predetermined value in response to the variation of the pitch when said two readout means read out the two waveform data simultaneously;

mixing means for mixing the two waveform data from said multitude control means; and musical tone signal output means for generating a musical tone signal based on the waveform data from said mixing means.

16. An apparatus according to claim 15, wherein each waveform data stored in said memory means has an attack portion and a loop portion for being repeatedly read out, and when said waveform readout means reads out new waveform data, only the loop portion of the new waveform data is read out.

17. An apparatus according to claim 15, wherein said pitch designation operation means comprises scale designation means for designating a pitch corresponding to a scale, and pitch varying means for varying a pitch of a musical tone in generation.

18. An apparatus according to claim 15, wherein said memory means comprises first and second memory means for storing waveform data corresponding to adjacent tone ranges.

* * * * *